US011107404B2

(12) United States Patent
Park

(10) Patent No.: US 11,107,404 B2
(45) Date of Patent: Aug. 31, 2021

(54) DISPLAY DEVICE AND METHOD OF DRIVING THE SAME

(71) Applicant: LG Display Co., Ltd., Seoul (KR)

(72) Inventor: Joon-Min Park, Seoul (KR)

(73) Assignee: LG DISPLAY CO., LTD., Seoul (KR)

( * ) Notice: Subject to any disclaimer, the term of this patent is extended or adjusted under 35 U.S.C. 154(b) by 35 days.

(21) Appl. No.: 16/681,286

(22) Filed: Nov. 12, 2019

(65) Prior Publication Data

US 2020/0160781 A1 May 21, 2020

(30) Foreign Application Priority Data

Nov. 16, 2018 (KR) ..... 10-2018-0141490

(51) Int. Cl.

| | |
|---|---|
| ***G09G 3/32*** | (2016.01) |
| ***G09G 3/325*** | (2016.01) |
| ***G09G 3/3266*** | (2016.01) |
| ***G09G 3/3291*** | (2016.01) |

(52) U.S. Cl.

CPC ..... *G09G 3/325* (2013.01); *G09G 3/3266* (2013.01); *G09G 3/3291* (2013.01); *G09G 2300/0847* (2013.01); *G09G 2310/027* (2013.01); *G09G 2330/021* (2013.01)

(58) Field of Classification Search

None

See application file for complete search history.

(56) References Cited

U.S. PATENT DOCUMENTS

| | | | | |
|---|---|---|---|---|
| 2015/0049075 | A1* | 2/2015 | Lim | G09G 5/397 345/212 |
| 2015/0325174 | A1* | 11/2015 | Yu | H01L 27/32 345/77 |
| 2018/0061293 | A1* | 3/2018 | Park | G09G 3/006 |

* cited by examiner

*Primary Examiner* — Carl Adams

(74) *Attorney, Agent, or Firm* — Seed IP Law Group LLP

(57) ABSTRACT

A display device includes a display panel having a plurality of gate lines, a plurality of data lines, and a plurality of subpixels; a gate driver circuit driving the plurality of gate lines; a data driver circuit driving the plurality of data lines; and a timing controller controlling signals applied to the gate driver circuit and the data driver circuit, wherein the timing controller controls the data driver circuit for a black data to be applied to at least one of designated subpixels among the plurality of subpixels, and controls the gate driver circuit for a gate signal, which is a signal for sensing a characteristic of a driving transistor of the designated subpixel, to be applied in an interval between times at which the black data are applied, such that the gate signal does not overlap the black data.

20 Claims, 22 Drawing Sheets

DISPLAY DEVICE AND METHOD OF DRIVING THE SAME

CROSS REFERENCE TO RELATED APPLICATION

This application claims priority to Korean Patent Application No. 10-2018-0141490, filed on Nov. 16, 2018, which is hereby incorporated by reference for all purposes as if fully set forth herein.

BACKGROUND

Technical Field

The present disclosure relates to a display device and a method of driving the same.

Description of the Related Art

With the development of the information society, there has been an increasing demand for a variety of types of image display devices. In this regard, a range of display devices, such as liquid crystal display (LCD) devices, plasma display devices, and organic light-emitting diode (OLED) display devices, have recently come into widespread use.

Among such display devices, organic light-emitting display devices have superior properties, such as rapid response speeds, high contrast ratios, high emissive efficiency, high luminance, and wide viewing angles, since self-emissive organic light-emitting diodes (OLEDs) are used.

Such an organic light-emitting display device may include organic light-emitting diodes disposed in a plurality of subpixels SP arrayed in a display panel, and may control the organic light-emitting diodes to emit light by controlling a voltage flowing through the organic light-emitting diodes, so as to display an image while controlling luminance of the subpixels.

Such an organic light-emitting display device may operate as a hold type of 60 Hz or a double rate driving (DRD) type of 120 Hz. While a video image is being displayed on a display panel, a portion of the image may be blurred, depending on the moving speed of an object in the video image. This may be caused by subpixel characteristics of organic light-emitting display devices and the motion picture response time (MPRT) as a quality measurement indicator for video image, which are different from those of other display devices, such as a cathode ray tube (CRT).

BRIEF SUMMARY

Black Data Insertion (BDI) method can be used to improve the MPRT of organic light-emitting display devices. The BDI method improves the MPRT by inserting black data into some area other than subpixels in which normal image data is displayed.

In such an organic light-emitting display device, an organic light-emitting diode (OLED) and a driving transistor to drive the organic light-emitting diode (OLED) are disposed in each subpixel SP defined in the display panel. At this time, there may be deviations in the characteristics of transistors in each subpixel SP, such as threshold voltage or mobility, due to changes over the driving time or different driving times among the subpixels SP. Accordingly, luminance deviations (or luminance non-uniformity) may occur among the subpixels SP, thereby degrading image quality.

In this regard, solutions for sensing a deviation in the characteristics of driving transistors and compensating for the deviation have been proposed in order to remove luminance deviations among the subpixels SP of the organic light-emitting display device. However, despite such solutions for sensing and compensating, display images may have failure due to sensing errors caused by unexpected reasons.

In particular, when black data for improving the MPRT is inserted into a period in which the characteristics of a transistor are sensed, deviations may occur in the sensing of the characteristics of the transistor, depending on the position in which the black data is inserted.

Various aspects of the present disclosure provide a display device and a method of driving the same, able to sense characteristics of driving transistors disposed in subpixels of a display panel and compensate for deterioration.

Also provided are a display device and a method of driving the same, able to reduce sensing deviations among the characteristics of the driving transistors by inserting black data into a period other than a sensing period for the characteristics of the driving transistors.

Also provided are a display device and a method of driving the same, able to accurately sense the characteristics of the driving transistors and accurately compensate for the deviations thereof by separating a real-time (RT) sensing period to sense the characteristics of the driving transistors and a recovery period in which a recovery voltage is applied to the subpixels.

According to an aspect, a display device may include: a display panel comprising a plurality of gate lines, a plurality of data lines, and a plurality of subpixels; a gate driver circuit driving the plurality of gate lines; a data driver circuit driving the plurality of data lines; and a timing controller controlling signals applied to the gate driver circuit and the data driver circuit, wherein the timing controller controls the data driver circuit for a black data to be applied to at least one of designated subpixels among the plurality of subpixels, and controls the gate driver circuit for a gate signal, which is a signal for sensing a characteristic of a driving transistor of the designated subpixel, to be applied in an interval between times at which the black data are applied, such that the gate signal does not overlap the black data.

The subpixel may include: an organic light-emitting diode; a driving transistor driving the organic light-emitting diode; a switching transistor electrically connected between a gate node of the driving transistor and a data line among the plurality of data lines; a sensing transistor electrically connected between a source node or a drain node of the driving transistor and a reference voltage line; and a storage capacitor electrically connected between the gate node and the source node or the drain node of the driving transistor.

The sensing of the characteristic of the driving transistor may include: an initialization period in which, in a state in which the switching transistor is turned on, a sensing data voltage is supplied through the data line, and a sensing reference voltage is supplied through the reference voltage line; a tracking period in which a voltage of the reference voltage line is increased in response to the sensing reference voltage being blocked; and a sampling period in which the characteristic of the driving transistor is sensed through the reference voltage line.

The gate signal, by which the characteristic of the driving transistor of the designated subpixel is sensed, may include: a scan signal, by which an operation of the switching transistor is controlled; and a sense signal, by which an operation of the sensing transistor is controlled.

The scan signal and the sense signal may be applied through a single gate line among the plurality of gate lines.

A cycle of the black data applied may be controlled to be the same as or different from a cycle of image data applied to the designated subpixel.

The display device according to one or more embodiments may further include a compensation circuit determining a compensation value for an image data voltage using a sensed value of the characteristic of the driving transistor and applying the image data voltage, changed according to the determined compensation value, to the designated subpixel.

The compensation circuit may include: an analog-to-digital converter measuring a voltage of a reference voltage line electrically connected to the driving transistor and converting the measured voltage into a digital value; a switch circuit electrically connected between the driving transistor and the analog-to-digital converter to control an operation of sensing the characteristic of the driving transistor; a memory storing the sensed value output from the analog-to-digital converter or retaining a reference sensing value previously stored therein; a compensator comparing the sensed value with the reference sensing value stored in the memory to determine the compensation value, by which a characteristic deviation of the driving transistor is compensated for; a digital-to-analog converter converting the image data voltage, changed according to the compensation value determined by the compensator, into an analog image data voltage; and a buffer outputting the analog image data voltage, output from the digital-to-analog converter, to a data line designated from among the plurality of data lines.

The black data may be applied to the designated subpixel via a switch circuit of the compensation circuit.

The switch circuit may include a sensing reference switch and a sampling switch for controlling a sensing driving, wherein the sensing reference switch may control the connection between each reference voltage line and a sensing reference voltage supply node, to which a reference voltage is supplied, and the sampling switch may control the connection between the reference voltage line and the analog-to-digital converter.

The switch circuit may further include an image driving reference switch used in an image driving, wherein the image driving reference switch may control connection between each reference voltage line and an image driving reference voltage supply node, to which the reference voltage is supplied.

The voltage of the reference voltage line may reflect a mobility of the driving transistor, and the range in which the voltage can be sensed may be determined by a resolution of the analog-to-digital converter.

According to another aspect, a method of driving a display device is provided, the display device may include a display panel in which a plurality of data lines and a plurality of gate lines are disposed, a plurality of subpixels are aligned in intersected areas by the data lines and the gate lines to light organic light-emitting diodes via driving transistors, and a plurality of reference voltage lines are disposed, a data driver circuit driving the plurality of data lines, and a gate driver circuit driving the plurality of gate lines, the method including: applying, via the data driver circuit, black data to a subpixel designated from among the plurality of subpixels in a predetermined cycle; and applying a gate signal, by which a characteristic of a driving transistor, among the driving transistors, provided in the designated subpixel, is sensed, in a period between points in time at which the black data is applied, such that the gate signal does not overlap the black data.

The method according to one or more embodiments may further include: initialization step for supplying a sensing data voltage through the data line and a sensing reference voltage through a reference voltage line, among the plurality of reference voltage lines, electrically connected to the designated subpixel; tracking step for increasing a voltage of the reference voltage line by blocking the sensing reference voltage; and sampling step for sensing the characteristic of the driving transistor through the reference voltage line.

The black data may be applied to the designated subpixel through a reference voltage line, among the plurality of reference voltage lines, electrically connected to the driving transistor.

According to another aspect, a display device may include: a display panel comprising of a plurality of gate lines, a plurality of data lines, and a plurality of subpixels; a gate driver circuit driving the plurality of gate lines; a data driver circuit driving the plurality of data lines; and a timing controller controlling signals applied to the gate driver circuit and the data driver circuit, wherein, in a blank period in which neither image data nor black data is applied, the timing controller controls a gate signal to sense a characteristic of a driving transistor in each of the plurality of subpixels in a first blank period and controls a recovery voltage to be applied in a second blank period subsequent to the first blank period to reset the plurality of subpixels on which characteristics sensing has been performed in the first blank period, wherein the gate signal does not overlap the black data.

The timing controller may control, via the data driver circuit, the black data to be applied to designated subpixels among the plurality of subpixels, and controls the gate signal for sensing the characteristic of the driving transistor to be applied in an interval between times at which the black data are applied, such that the gate signal does not overlap the black data.

The first blank period may include: an initialization period in which a sensing data voltage is supplied through the data line and a sensing reference voltage is supplied through a reference voltage line electrically connected to the sensed subpixel; a tracking period in which a voltage of the reference voltage line by blocking the sensing reference voltage is increased; and a sampling period in which the characteristic of the driving transistor through the reference voltage line is sensed.

According to another aspect, a method of driving a display device is provided, the display device may include a display panel in which a plurality of data lines and a plurality of gate lines are disposed, a plurality of subpixels are arrayed in areas defined by intersection of the data lines and the gate lines to light organic light-emitting diodes via driving transistors, and a plurality of reference voltage lines are disposed, a data driver circuit driving the plurality of data lines, and a gate driver circuit driving the plurality of gate lines, the method including: for a blank period in which neither image data nor black data is applied, applying a gate signal to sense a characteristic of a driving transistor in each of the plurality of subpixels in a first blank period; and applying a recovery voltage in a second blank period to reset the plurality of subpixels on which characteristics sensing has been performed in the first blank period, wherein the second blank period is subsequent to the first blank period, wherein the gate signal does not overlap the black data.

The method according one or more embodiments may further include: applying, via the data driver circuit, the black data to designated subpixels among the plurality of subpixels; and applying the gate signal for sensing the characteristic of the driving transistor in an interval between times at which the black data are applied, such that the gate signal does not overlap the black data.

According to another aspect, a display device may include a display panel including a plurality of gate lines, a plurality of data lines, and a plurality of subpixels; a gate driver circuit driving the plurality of gate lines; a data driver circuit driving the plurality of data lines; and a timing controller controlling signals applied to the gate driver circuit and the data driver circuit, wherein the timing controller may control the data driver circuit to apply a black data to another data line spaced apart from a data line, to which an image data is applied, by a certain distance, and for a blank period in which neither the image data nor the black data is applied, the timing controller may control the gate driver circuit to apply a gate signal to sense a characteristic of a driving transistor in each of the plurality of subpixels, such that the gate signal does not overlap the black data.

The blank period may include a first blank period in which the timing controller controls the gate signal to sense the characteristic of the driving transistor and a second blank period subsequent to the first blank period in which the timing controller controls a recovery voltage to be applied to reset the plurality of subpixels on which characteristics sensing has been performed in the first blank period.

According to another aspect, a method of driving a display device is provided, the display device may include a display panel in which a plurality of data lines and a plurality of gate lines are disposed, a plurality of subpixels are aligned in intersected areas by the data lines and the gate lines to light organic light-emitting diodes via driving transistors, a data driver circuit driving the plurality of data lines, and a gate driver circuit driving the plurality of gate lines, the method comprising: applying, via the data driver circuit, black data to apply a black data to another data line spaced apart from a data line, to which an image data is applied, by a certain distance; and for a blank period in which neither the image data nor the black data is applied, applying, via the gate driver circuit, a gate signal to sense a characteristic of a driving transistor in each of the plurality of subpixels, such that the gate signal does not overlap the black data.

According to another aspect, a display device may include: a display panel including a plurality of gate lines, a plurality of data lines, and a plurality of subpixels; a gate driver circuit driving the plurality of gate lines; a data driver circuit driving the plurality of data lines; and a timing controller controlling signals applied to the gate driver circuit and the data driver circuit, wherein the timing controller controls the data driver circuit to apply a black data to a first subpixel of the plurality of subpixels, and controls the gate driver circuit to apply a gate signal, which is a signal for sensing a characteristic of a driving transistor of the first subpixel, in an interval between times at which the data driver circuit applies the black data to the first subpixel.

The first subpixel may include: an organic light-emitting diode driven by the driving transistor; a switching transistor electrically connected between a gate node of the driving transistor and a data line among the plurality of data lines; a sensing transistor electrically connected between a source node or a drain node of the driving transistor and a reference voltage line; and a storage capacitor electrically connected between the gate node and the source node or the drain node of the driving transistor.

The sensing of the characteristic of the driving transistor may include: an initialization period in which, the switching transistor is turned on, and a sensing data voltage is supplied through the data line, and a sensing reference voltage is supplied through the reference voltage line; a tracking period in which the sensing reference voltage to the driving transistor is blocked; and a sampling period in which the characteristic of the driving transistor is sensed through the reference voltage line.

The gate signal, by which the characteristic of the driving transistor of the first subpixel is sensed, may include: a scan signal, by which an operation of the switching transistor is controlled; and a sense signal, by which an operation of the sensing transistor is controlled.

The scan signal and the sense signal may be applied through a single gate line among the plurality of gate lines.

A cycle of the black data applied may be controlled to be the same as or different from a cycle of image data applied to the first subpixel.

The compensation circuit may include: an analog-to-digital converter measuring a voltage of a reference voltage line electrically connected to the driving transistor and converting the measured voltage into a digital value; a switch circuit electrically connected between the driving transistor and the analog-to-digital converter to control an operation of sensing the characteristic of the driving transistor; a memory storing the sensed value output from the analog-to-digital converter or retaining a reference sensing value previously stored therein; a compensator comparing the sensed value with the reference sensing value stored in the memory to determine the compensation value, by which a characteristic deviation of the driving transistor is compensated for; a digital-to-analog converter converting the image data voltage, changed according to the compensation value determined by the compensator, into an analog image data voltage; and a buffer outputting the analog image data voltage, output from the digital-to-analog converter, to a data line designated from among the plurality of data lines.

The black data may be applied to the first subpixel via a switch circuit of the compensation circuit.

The switch circuit may include a sensing reference switch and a sampling switch for controlling a sensing driving, wherein the sensing reference switch controls the connection between the reference voltage line and a sensing reference voltage supply node, to which a reference voltage is supplied, and the sampling switch controls a connection between the reference voltage line and the analog-to-digital converter.

The switch circuit may further include an image driving reference switch used in an image driving, wherein the image driving reference switch controls a connection between the reference voltage line and an image driving reference voltage supply node, to which the reference voltage is supplied.

The voltage of the reference voltage line may reflect a mobility of the driving transistor, and a range in which the voltage of the reference voltage line can be sensed is determined by a resolution of the analog-to-digital converter.

According to another aspect, a method of driving a display device is provided, the method may include: applying, by a data driver circuit, black data to a first subpixel of a plurality of subpixels in a predetermined cycle; and applying a gate signal, by which a characteristic of a driving transistor of the first subpixel is sensed, in a period between points in time at which the black data is applied, and the gate signal does not overlap the black data.

The method according to one or more embodiments may further include: supplying a sensing data voltage through a data line and a sensing reference voltage through a reference voltage line electrically connected to the first subpixel; increasing a voltage of the reference voltage line by blocking the sensing reference voltage; and sensing the characteristic of the driving transistor through the reference voltage line.

The gate signal for sensing the characteristic of the driving transistor may include: a scan signal for controlling an operation of a switching transistor included in the first subpixel; and a sense signal for controlling an operation of a sensing transistor included in the first subpixel.

A cycle of the black data applied may be controlled to be the same as or different from a cycle of image data applied to the first subpixel.

The black data may be applied to the first subpixel through a reference voltage line electrically connected to the driving transistor.

According to another aspect, a display device may include: a display panel including a plurality of gate lines, a plurality of data lines, and a plurality of subpixels; a gate driver circuit driving the plurality of gate lines; a data driver circuit driving the plurality of data lines; and a timing controller controlling signals applied to the gate driver circuit and the data driver circuit, wherein, neither image data nor black data is applied to the plurality of subpixels in a first blank period, the timing controller controls gate signals to sense a characteristic of a driving transistor in each of the plurality of subpixels in the first blank period and controls a recovery voltage to be applied in a second blank period subsequent to the first blank period to reset the plurality of subpixels on which characteristics sensing has been performed in the first blank period, and wherein, a first gate signal applied to a first subpixel of the plurality of subpixels in the first blank period does not overlap the black data applied to the first subpixel.

The timing controller may control, by the data driver circuit, the black data to be applied to designated subpixels among the plurality of subpixels, and controls the gate signals for sensing the characteristic of the driving transistor to be applied in an interval between times at which the black data is applied.

The first blank period may include: an initialization period in which a sensing data voltage is supplied through a data line of the plurality of data lines and a sensing reference voltage is supplied through a reference voltage line electrically connected to the first subpixel; a tracking period in which a voltage of the reference voltage line is increased by blocking the sensing reference voltage; and a sampling period in which the characteristic of a driving transistor in the first subpixel is sensed through the reference voltage line.

According to another aspect, a method of driving a display device is provided, the method may include: neither image data nor black data is applied to a plurality of subpixels in a first blank period, applying gate signals to sense a characteristic of a driving transistor in each of the plurality of subpixels in a first blank period; and applying a recovery voltage in a second blank period to reset the plurality of subpixels on which characteristic sensing has been performed in the first blank period, wherein the second blank period is subsequent to the first blank period, wherein, a first signal of the gate signals for a first subpixel of the plurality of subpixels in the first blank period does not overlap the black data applied to the first subpixel.

The first blank period may include: an initialization period in which a sensing data voltage is supplied through a data line and a sensing reference voltage is supplied through a reference voltage line electrically connected to the first subpixel; a tracking period in which the sensing reference voltage to the first subpixel is blocked; and a sampling period in which the characteristic of a driving transistor in the first subpixel is sensed through the reference voltage line.

The method according to one or more embodiments may further includes: applying, by a data driver circuit, the black data to the first subpixel of the plurality of subpixels; and applying the gate signals to sense the characteristic of the driving transistor in an interval between times at which the black data is applied.

According to one or more embodiments, it is possible to sense characteristics of driving transistors disposed in subpixels of the display panel and perform compensation based on the sensing, thereby improving the image quality of the organic light-emitting display device.

According to one or more embodiments, it is possible to reduce sensing deviations among the characteristics of the driving transistors by inserting black data into a period other than a period in which the characteristics of the driving transistors are sensed.

According to one or more embodiments, it is possible to accurately sense the characteristics of the driving transistors and accurately compensate for the deviations thereof by separating a real-time (RT) sensing period in which the characteristics of the driving transistors are sensed and a recovery period in which a recovery voltage is applied to the subpixels.

DESCRIPTION OF THE SEVERAL VIEWS OF THE DRAWINGS

The above and other objects, features, and advantages of the present disclosure will be more clearly understood from the following detailed description, taken in conjunction with the accompanying drawings, in which.

DETAILED DESCRIPTION

Figure 1:
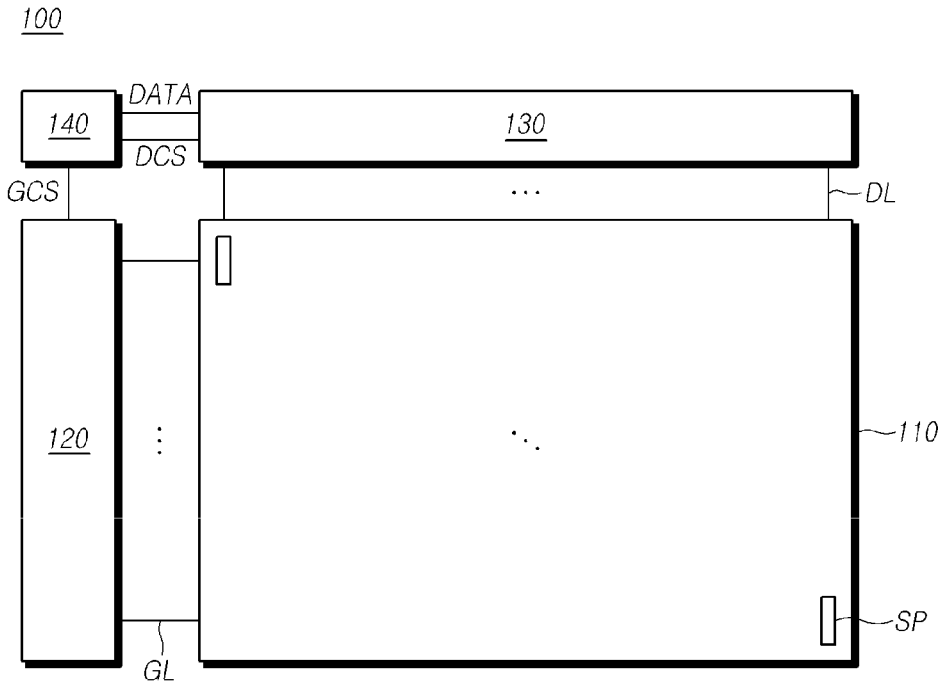
FIG. 1 illustrates a schematic configuration of a display device according to one or more embodiments.

The advantages and features of the present disclosure and methods of the realization thereof will be apparent with reference to the accompanying drawings and detailed descriptions of the embodiments. The present disclosure should not be construed as being limited to the embodiments set forth herein and may be embodied in many different forms. Rather, these embodiments are provided so that the present disclosure will be thorough and complete, and will fully convey the scope of the present disclosure to a person having ordinary skill in the art.

The shapes, sizes, ratios, angles, numbers, and the like, inscribed in the drawings to illustrate various embodiments are illustrative only, and the present disclosure is not limited to the embodiments illustrated in the drawings. Throughout this document, the same reference numerals and symbols will be used to designate the same or like components. In the following description of the present disclosure, detailed descriptions of known functions and components incorporated into the present disclosure will be omitted in the case that the subject matter of the present disclosure may be rendered unclear thereby. It will be understood that the terms "comprise," "include," "have," and any variations thereof used herein are intended to cover non-exclusive inclusions unless explicitly described to the contrary. Descriptions of components in the singular form used herein are intended to include descriptions of components in the plural form, unless explicitly described to the contrary.

In the analysis of components according to various embodiments, it shall be understood that an error range is included therein, even in the case in which there is no explicit description thereof.

It will also be understood that, while terms, such as "first," "second," "A," "B," "(a)," and "(b)," may be used herein to describe various elements, such terms are merely used to distinguish one element from other elements. The substance, sequence, order, or number of such elements is not limited by these terms. It will be understood that when an element is referred to as being "connected," "coupled," or "linked" to another element, not only can it be "directly connected, coupled, or linked" to the other element, but it can also be "indirectly connected, coupled, or linked" to the other element via an "intervening" element. In the same context, it will be understood that when an element is referred to as being formed "on" or "under" another element, not only can it be directly located on or under the other element, but it can also be indirectly located on or under the other element via an intervening element.

In addition, terms, such as "first" and "second" may be used herein to describe a variety of components. It should be understood, however, that these components are not limited by these terms. These terms are merely used to discriminate one element or component from other elements or components. Thus, an element referred to as first element hereinafter may be a second element within the spirit of the present disclosure.

The features of one or more embodiments of the present disclosure may be partially or entirely coupled or combined with each other and may work in concert with each other or may operate in a variety of technical methods. In addition, respective one or more embodiments may be carried out independently or may be associated with and carried out in concert with other embodiments.

Hereinafter, one or more embodiments will be described in detail with reference to the drawings.

FIG. 1 illustrates a schematic configuration of a display device according to one or more embodiments.

Referring to FIG. 1, the display device 100 according to one or more embodiments may include a display panel 110 in which a plurality of subpixels SP are arrayed in rows and columns, a gate driver circuit 120 and a data driver circuit 130 driving the display panel 110, and a timing controller 140 controlling the gate driver circuit 120 and the data driver circuit 130.

In the display panel 110, a plurality of gate lines GL and a plurality of data lines DL are disposed, and a plurality of subpixels SP are arrayed in adjacent areas in which the plurality of gate lines GL overlap the plurality of data lines DL. For example, in an organic light-emitting display device having a resolution of 2,160×3,840, that is, 2,160 gate lines GL and 3,840 data lines DL may be provided, and plurality of subpixels SP may be arrayed in adjacent areas in which the plurality of gate lines GL intersect the plurality of data lines DL.

The gate driver circuit 120 is controlled by the timing controller 140, and controls the driving timing of the plurality of subpixels SP by sequentially outputting a scan signal to the plurality of gate lines GL disposed in the display panel 110. In the organic light-emitting display device 100 having a resolution of 2,160×3,840, sequential output of the scan signal to the 2,160 gate lines GL from the first gate line GL1 to the 2,160th gate line GL may be referred to as 2,160 phase driving. In addition, a case in which the scan signal is output sequentially to every four gate lines, as in a case in which the scan signal is output sequentially to four gate lines, such as first to fourth gate lines GL1 to GL4, and then is output sequentially to next four gate lines, such as fifth to eighth gate lines GL5 to GL8, is referred to as 4 phase driving. As described above, a case in which the scan signal is output sequentially to every N number of gate lines may be referred as N-phase driving.

The gate driver circuit 120 may include one or more gate driver integrated circuits (GDIC), which may be disposed on one side or both sides of the display panel 110 depending on the driving system. Alternatively, the gate driver circuit 120 may be implemented using a gate-in-panel (GIP) structure embedded in a bezel area of the display panel 110.

In addition, the data driver circuit 130 receives image data from the timing controller 140, and converts the received image data into an analog data voltage Vdata. Afterwards, the data driver circuit 130 outputs the data voltage Vdata to each of the data lines DL at points in time at which the scan signal is applied through the gate lines GL, so that each of the subpixels SP connected to the data lines DL are lit at a corresponding luminance in response to the data voltage Vdata.

Likewise, the data driver circuit 130 may include one or more source driver ICs (SDICs). Each of the source driver ICs may be connected to a bonding pad of the display panel 110 by a tape-automated bonding (TAB) method or a chip-on-glass (COG) method, or may be directly mounted on the display panel 110. In some cases, each of the source driver ICs may be integrated with the display panel 110. In addition, each of the source driver ICs may be implemented using a chip-on-film (COF) structure. In this case, the source driver ICs may be mounted on circuit films to be electrically connected to the data lines DL in the display panel 110 via the circuit films.

The timing controller 140 supplies a variety of control signals to the gate driver circuit 120 and the data driver circuit 130, and controls the operations of the gate driver circuit 120 and the data driver circuit 130. That is, the timing controller 140 controls the gate driver circuit 120 to output the scan signal at points in time realized by respective frames, and on the other hand, converts data input from an external source into image data DATA having a data signal format readable by the data driver circuit 130 and outputs the converted image data DATA to the data driver circuit 130.

Here, the timing controller 140 receives a variety of timing signals, including a vertical synchronization signal Vsync, a horizontal synchronization signal Hsync, an input data enable (DE) signal, a clock (CLK) signal, and the like, from an external source (e.g., a host system). Accordingly, the timing controller 140 generates a variety of control signals using the variety of timing signals received from the external source, and outputs the variety of control signals to the gate driver circuit 120 and the data driver circuit 130.

For example, the timing controller 140 outputs a variety of gate control signals GCS, including a gate start pulse (GSP) signal, a gate shift clock (GSC) signal, a gate output enable (GOE) signal, and the like, to control the gate driver circuit 120. Here, the gate start pulse signal is used to control the operation start timing of one or more gate driver ICs of the gate driver circuit 120. In addition, the gate shift clock signal is a clock signal commonly input to the one or more gate driver ICs to control the shift timing of the scan signal. The gate output enable signal designates timing information of the one or more gate driver ICs.

In addition, the timing controller 140 outputs a variety of data control signals DCS, including a source start pulse (SSP) signal, a source sampling clock (SSC) signal, a source output enable (SOE) signal, and the like, to control the data driver circuit 130. Here, the source start pulse signal is used to control the data sampling start timing of one or more source driver ICs of the data driver circuit 130. The source sampling clock signal is a clock signal controlling the sampling timing of data in each of the source driver ICs. The source output enable signal controls the output timing of the data driver circuit 130.

The organic light-emitting display device 100 may further include a power management IC (PMIC) supplying various forms of voltage or current to the display panel 110, the gate driver circuit 120, the data driver circuit 130, and the like, or control various forms of voltage or current to be supplied to the same.

The subpixels SP are located adjacent to points at which the gate lines GL overlap the data lines DL, and a light-emitting element may be disposed in each of the subpixels SP. For example, the organic light-emitting display device 100 includes an light-emitting element, such as a light-emitting diode (LED) or an organic light-emitting diode (OLED) in each of the subpixels SP, and may display an image by controlling current flowing through the light-emitting elements in response to the data voltage Vdata.

Figure 2:
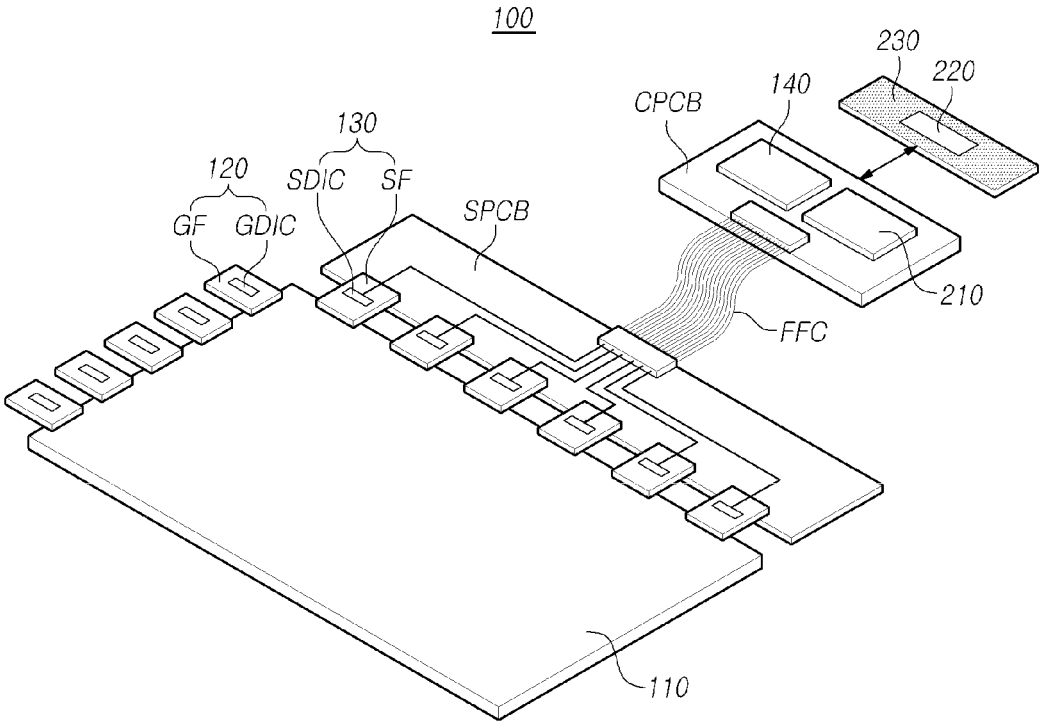
FIG. 2 illustrates a system of the display device according to one or more embodiments.

FIG. 2 illustrates a system of the display device according to one or more embodiments.

In the organic light-emitting display device 100 illustrated in FIG. 2, each of the source driver ICs SDIC of the data driver circuit 130 is implemented using a COF structure among a plurality of structures, such as a TAB structure, a COG structure, and a COF structure, and the gate driver circuit 120 is implemented using a GIP structure among a variety of structures, such as a TAB structure, a COG structure, a COF structure, and a GIP structure.

The source driver ICs SDIC of the data driver circuit 130 may be mounted on source-side circuit films SF, respectively. One portion of each of the source-side circuit films SF may be electrically connected to the display panel 110. In addition, lines may be disposed in the top portion of the source-side circuit films SF to electrically connect the source driver ICs SDIC and the display panel 110. The gate driver ICs GDIC of the gate driver circuit 120 may be mounted on gate-side circuit films GF, respectively.

The organic light-emitting display device 100 may include at least one source printed circuit board SPCB and a control printed circuit board CPCB, on which control components and a variety of electric devices are mounted, in order to connect the plurality of source driver ICs SDIC to the circuits of the other devices.

The other portion of each of the circuit films SF, on which the source driver ICs SDIC are mounted, may be connected to the at least one source printed circuit board SPCB. That is, one portion of each of the circuit films SF, on which the source driver ICs SDIC are mounted, may be electrically connected to the display panel 110, while the other portion of each of the source-side circuit films SF may be electrically connected to the source printed circuit board SPCB.

The timing controller 140 and a power management IC (PMIC) 210 may be mounted on the control printed circuit board CPCB. The timing controller 140 may control the operations of the data driver circuit 130 and the gate driver circuit 120. The power management IC 210 may supply various forms of voltage or current, including a driving voltage, to the data driver circuit 130, the gate driver circuit 120, and the like, or may control the voltage or current to be supplied to the same.

A circuit connection between the at least one source printed circuit board SPCB and the control printed circuit board CPCB may be provided by at least one connecting member. The connecting member may be, for example, a flexible printed circuit (FPC), a flexible flat cable (FFC), or the like. The at least one source printed circuit board SPCB and the control printed circuit board CPCB may be integrated into a single printed circuit board.

The organic light-emitting display device 100 may further include a set board 230 electrically connected to the control printed circuit board CPCB. The set board 230 may also be referred to as a power board. A main power management circuit (M-PMC) 220 performing overall power management of the organic light-emitting display device 100 may be present on the set board 230. The main power management circuit 220 may work in concert with the power management IC 210.

In the organic light-emitting display device 100 having the above-described configuration, a driving voltage EVDD is generated by the set board 230 to be transferred to the power management IC 210. The power management IC 210 transfers the driving voltage EVDD, which is used during an image driving period or a sensing period, to the source printed circuit board SPCB through a flexible flat cable FFC, or via a flexible printed circuit (FPC). The driving voltage EVDD, transferred to the source printed circuit board SPCB, is supplied to a specific subpixel SP in the display panel 110 via the source driver ICs SDIC, so that the subpixel SP is lit or performs a sensing operation.

Each of the subpixels SP, arrayed in the display panel 110 of the organic light-emitting display device 100, may include a light-emitting element, such as an organic light-emitting diode (OLED), and circuit elements, such as a driving transistor, driving the organic light-emitting diode.

The type and number of circuit elements of each of the subpixels SP may be variously determined, depending on the function provided, the design, or the like.

Figure 3:
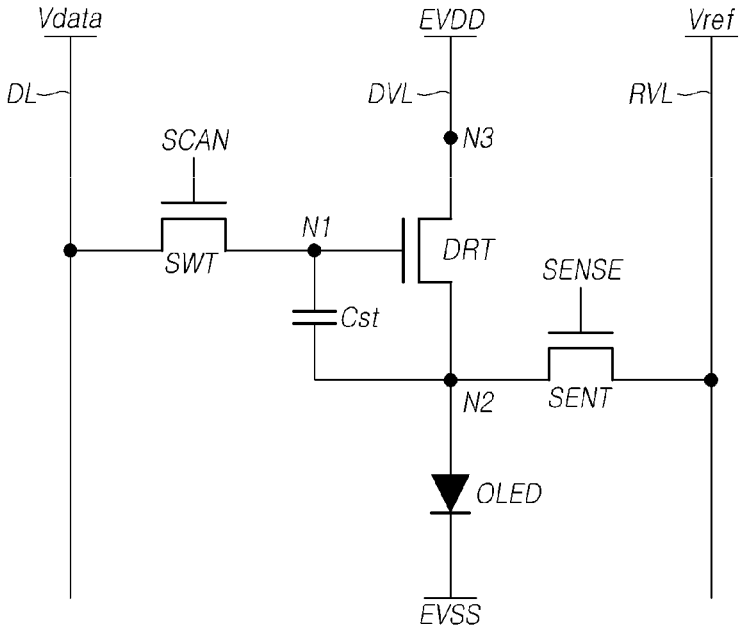
FIG. 3 illustrates a circuit structure of each of the subpixels arrayed in the organic light-emitting display device according to one or more embodiments.

FIG. 3 illustrates a circuit structure of each of the subpixels SP arrayed in the organic light-emitting display device according to one or more embodiments.

Referring to FIG. 3, each of the subpixels SP arrayed in the organic light-emitting display device 100 according to one or more embodiments may include one or more transistors and a capacitor, with an organic light-emitting diode OLED being disposed therein. For example, the subpixel SP may include a driving transistor DRT, a switching transistor SWT, a sensing transistor SENT, a storage capacitor Cst, and the organic light-emitting diode OLED.

Here, the switching transistor SWT may be on-off controlled by a scan signal SCAN applied to a gate node thereof through a corresponding gate line. The sensing transistor SENT may be on-off controlled by a sense signal SENSE, different from the scan signal SCAN, applied to a gate node thereof through the corresponding gate line.

The driving transistor DRT has a first node N1, a second node N2, and a third node N3. The first node N1 of the driving transistor DRT may be a gate node, to which a data voltage Vdata is applied through a data line DL, when the switching transistor SWT is turned on. The second node N2 of the driving transistor DRT may be electrically connected to an anode of the organic light-emitting diode OLED, and may be a drain node or a source node.

Here, in the image driving period, the driving voltage EVDD for the image driving period may be supplied to the driving voltage line DVL. For example, the driving voltage EVDD for the image driving period may be about 27V.

The switching transistor SWT is electrically connected between the first node N1 of the driving transistor DRT and the data line DL. The switching transistor SWT operates in response to the scan signal SCAN supplied thereto through the gate line GL as the gate line GL is connected to the gate node. In addition, when the switching transistor SWT is turned on, the data voltage Vdata supplied through the data line DL is transferred to the gate node of the driving transistor DRT, thereby controlling the operation of the driving transistor DRT.

The sensing transistor SENT is electrically connected between the second node of the driving transistor DRT and a reference voltage line RVL, and operates in response to the sense signal SENSE supplied thereto through the gate line GL as the gate line GL is connected to the gate node. When the sensing transistor SENT is turned on, a sensing reference voltage Vref supplied through the reference voltage line RVL is transferred to the second node N2 of the driving transistor DRT. That is, the voltages of the first node N1 and the second node N2 of the driving transistor DRT may be controlled by controlling the switching transistor SWT and the sensing transistor SENT. Consequently, a current for driving the organic light-emitting diode OLED can be supplied.

The switching transistor SWT and the sensing transistor SENT may be connected to a single gate line GL or to different signal lines. Hereinafter, a structure by which the switching transistor SWT and the sensing transistor SENT are connected to different signal lines will be described by way of example. In this case, the switching transistor SWT is controlled by the scan signal transferred through the gate line GL, and the sensing transistor SENT is controlled by the sense signal SENSE.

In addition, the transistors disposed in the subpixels SP may be not only n-type transistors, but also p-type transistors. The transistors will be described as being n-type transistors hereinafter by way of example.

The storage capacitor Cst is electrically connected between the first node N1 and the second node N2 of the driving transistor DRT, and serves to maintain the data voltage Vdata for a one-frame period.

Such a storage capacitor Cst may be connected between the first node N1 and the third node N3 of the driving transistor DRT, depending on the type of the driving transistor DRT. The anode of the organic light-emitting diode OLED may be electrically connected to the second node N2 of the driving transistor DRT, and a base voltage EVSS may be applied to a cathode of the organic light-emitting diode OLED. Here, the base voltage EVSS may be the ground voltage or a voltage higher or lower than the ground voltage. In addition, the base voltage EVSS may vary depending on the driving condition. For example, the base voltage EVSS at a point in time during the image driving may be set different from the base voltage EVSS at a point in time during the sensing driving.

The structure of the subpixel SP as described above has a 3T1C structure comprised of three transistors and one capacitor. However, this is merely for illustrative purposes, and one or more transistors, or in some cases, one or more capacitors may be further included. In addition, the plurality of subpixels SP may have the same structure, or some of the plurality of subpixels SP may have a different structure from the remaining subpixels.

The image driving in which the subpixels SP are lit may be performed by an image data writing step, a boosting step, and an emission step.

In the image data writing step, an image-driving data voltage Vdata corresponding to an image signal may be applied to the first node N1 of the driving transistor DRT, and an image-driving reference voltage Vref may be applied to the second node N2 of the driving transistor DRT. Here, a voltage similar to the image-driving reference voltage Vref may be applied to the second node N2 of the driving transistor DRT, due to a resistance component or the like between the second node N2 of the driving transistor DRT and the reference voltage line RVL. The image-driving reference voltage Vref is also indicated by VpreR. In the image data writing step, the storage capacitor Cst may be charged with an electric charge Vdata-Vref corresponding to a potential difference between both ends.

Application of the image-driving data voltage Vdata to the first node N1 of the driving transistor DRT is referred to as image data writing. In the boosting step subsequent to the image data writing step, the first node N1 and the second node N2 of the driving transistor DRT may be electrically floated. In this regard, the switching transistor SWT may be turned off by the scan signal SCAN having a turn-off level. In addition, the sensing transistor SENT may be turned off by the sense signal SENSE having a turn-off level.

In the boosting step, the voltage of the first node N1 and the voltage of the second node N2 of the driving transistor DRT may be boosted while the voltage difference between the first node N1 and the second node N2 of the driving transistor DRT is being maintained. When the boosted voltage of the second node N2 of the driving transistor DRT reaches a certain voltage level or higher through the boosting of the voltages of the first node N1 and the second node N2 of the driving transistor DRT during the boosting step, the operation enters the emission step. The certain voltage level is a voltage level by which the organic light-emitting diode OLED can be turned on.

In the emission step, driving current flows to the organic light-emitting diode OLED, so that the organic light-emitting diode OLED can emit light.

Here, the driving transistor DRT disposed in each of the plurality of subpixels SP has unique characteristics, such as threshold voltage and mobility. However, the driving transistor DRT may be deteriorated as the driving time elapses, and the unique characteristics of the driving transistor DRT may change according to the driving time.

When the characteristics of the driving transistor DRT change, on-off times thereof may be changed, or the driving performance of the organic light-emitting diode OLED may be changed. That is, points in time at which current is supplied to the organic light-emitting diode OLED and the amount of current supplied to the organic light-emitting diode OLED may change along with changes in the characteristics. Consequently, changes in the characteristics of the driving transistor DRT may change the actual luminance level of the corresponding subpixel SP. In addition, since the plurality of subpixels SP, arrayed in the display panel 110, may have different driving times, the driving transistors DRT in the subpixels SP may have deviations in the characteristics, such as threshold voltage and mobility.

Such deviations in the characteristics among the driving transistors DRT may lead to different luminance levels among the subpixels SP. Accordingly, the luminance uniformity of the display panel 110 may be deteriorated, thereby degrading image quality.

The organic light-emitting display device 100 according to one or more embodiments may use a method of measuring a charged voltage of the storage capacitor Cst in the sensing period of the driving transistor DRT in order to effectively sense characteristics (e.g., threshold voltage or mobility) of the driving transistor DRT. In this regard, according to one or more embodiments, the organic light-emitting display device 100 may include a compensation circuit able to compensate for the characteristics deviations among the driving transistors DRT, and a compensation method using the compensation circuit may be provided.

That is, the characteristics or changes in the characteristics of the driving transistor DRT in the subpixel SP may be determined by measuring the charged voltage of the storage capacitor Cst in the sensing period of the driving transistor DRT. Here, the reference voltage line RVL may not only serve to transfer the reference voltage Vref but also serve as a sensing line to sense the characteristics of the driving transistor DRT in the subpixel SP. Thus, the reference voltage line RVL may also be referred to as a sensing line.

For example, in the organic light-emitting display device 100 according to one or more embodiments, the characteristics or changes in the characteristics of the driving transistor DRT in the subpixel SP may correspond to a voltage difference, e.g., Vdata−Vref, between the first node N1 and the second node N2 of the driving transistor DRT.

Figure 4:
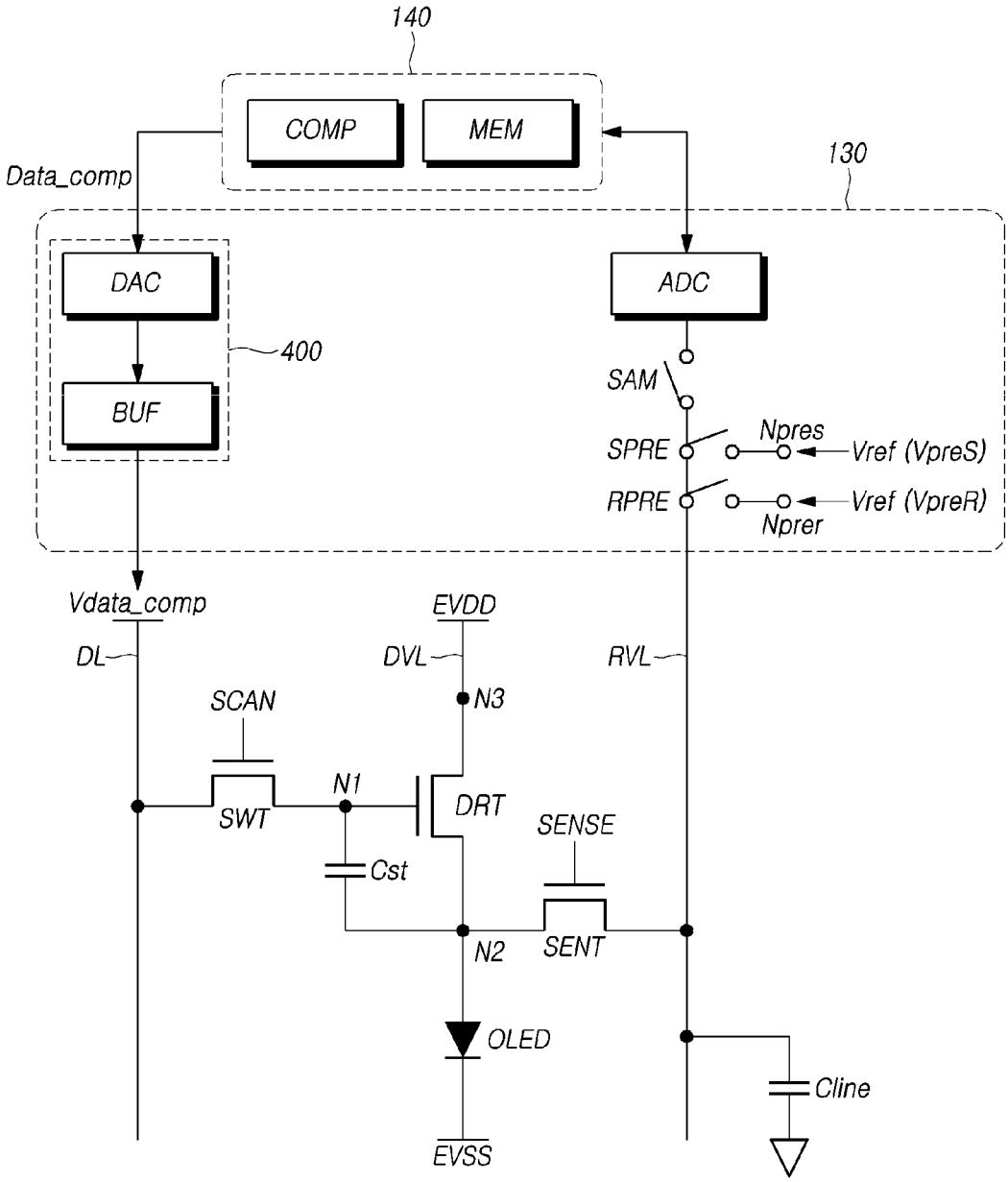
FIG. 4 illustrates a compensation circuit of the organic light-emitting display device according to one or more embodiments.

FIG. 4 illustrates a compensation circuit of the organic light-emitting display device according to one or more embodiments.

Referring to FIG. 4, the organic light-emitting display device 100 according to one or more embodiments enables to sense the characteristics or changes in the characteristics of each of the driving transistors DRT in order to compensate for characteristics deviations among the transistors DRT. In this regard, the compensation circuit of the organic light-emitting display device 100 according to one or more embodiments may include components for sensing the characteristics or changes in the characteristics of the driving transistors DRT in the subpixels SP in the sensing period, in a case in which each of the subpixels SP has a 3T1C structure or a modified structure based on the 3T1C structure.

In the sensing period, the organic light-emitting display device 100 according to one or more embodiments may sense a voltage of the reference voltage line RVL and determine the characteristics or the change in the characteristics of the driving transistor DRT in the subpixel SP from the sensed voltage. The reference voltage line RVL may not only serve to transfer the reference voltage but also serve as a sensing line to sense the characteristics of the driving transistor DRT in the subpixel SP. Thus, the reference voltage line RVL may also be referred to as a sensing line.

Specifically, in the sensing period of the organic light-emitting display device 100 according to one or more embodiments, the characteristics or changes in the characteristics of the driving transistor DRT may be reflected as a voltage, e.g., Vdata-Vth, of the second node N2 of the driving transistor DRT. The voltage of the second node N2 of the driving transistor DRT may correspond to the voltage of the reference voltage line RVL when the sensing transistor SENT is in a turned-on state. In addition, a line capacitor Cline on the reference voltage line RVL may be charged by the voltage of the second node N2 of the driving transistor DRT. Due to the charged line capacitor Cline, the reference voltage line RVL may have a voltage corresponding to the voltage of the node N2 of the driving transistor DRT.

The compensation circuit of the organic light-emitting display device 100 according to one or more embodiments may perform compensation driving by on-off controlling the switching transistor SWT and the sensing transistor SENT in the subpixel SP serving as a sensing target, and controlling the supply of the data voltage Vdata and the reference voltage Vref, so that the second node N2 of the driving transistor DRT has a voltage condition reflecting the characteristics (e.g., threshold voltage or mobility) or a change in the characteristics of the driving transistor DRT.

The compensation circuit of organic light-emitting display device 100 according to one or more embodiments may include an analog-to-digital converter ADC and a switch circuit SAM and SPRE. The analog-to-digital converter ADC measures the voltage of the reference voltage line RVL, corresponding to the voltage of the second node N2 of the driving transistor DRT, and converts the measured voltage into a digital value. The switch circuit SAM and SPRE is provided for sensing of the characteristics.

The switch circuit SAM and SPRE controlling the sensing driving may include a sensing reference switch SPRE controlling the connection between each reference voltage line RVL and a sensing reference voltage supply node Npres, to which the reference voltage Vref is supplied, and a sampling switch SAM controlling the connection between the reference voltage line RVL and the analog-to-digital converter ADC. Here, the sensing reference switch SPRE is a switch controlling the sensing driving. Due to the sensing reference switch SPRE, the reference voltage Vref, supplied to the reference voltage line RVL, corresponds to a "sensing reference voltage VpreS."

In addition, the characteristics sensing switch circuit may further include an image driving reference switch RPRE used in the image driving. The image driving reference switch RPRE may control connection between each reference voltage line RVL and an image driving reference voltage supply node Nprer, to which the reference voltage Vref is supplied. The image driving reference switch RPRE is a switch used in the image driving. Due to the image driving reference switch RPRE, the reference voltage Vref, supplied to the reference voltage line RVL, corresponds to an "image driving reference voltage VpreR."

Here, the sensing reference switch SPRE and the image driving reference switch RPRE may be provided separately or integrated into a single switch. The sensing reference voltage VpreS and the image driving reference voltage VpreR may be the same value or different values.

In the compensation circuit of the organic light-emitting display device 100 according to one or more embodiments, the timing controller 140 may include a memory MEM and a compensator COMP. The memory MEM stores a sensed value output by the analog-to-digital converter ADC, or retains a reference sensing value that has been previously stored. The compensator COMP determines a compensation value, by which a characteristics deviation is compensated for, by comparing the sensed value and the reference sensing value stored in the memory MEM. The compensation value determined by the compensator COMP may be stored in the memory MEM.

The timing controller 140 may change the data voltage DATA in the form of a digital signal, supposed to be supplied to the data driver circuit 130, using the compensation value determined by the compensator COMP, and output the changed data voltage Data_comp to the data driver circuit 130. Consequently, the characteristics deviations (e.g., the threshold voltage deviations or mobility deviations) of the driving transistor DRT of the corresponding subpixel SP can be compensated for.

In addition, the data driver circuit 130 may include a data voltage output circuit 400 including a latch circuit, a digital-to-analog converter DAC, an output buffer BUF, and the like. In some cases, the data driver circuit 130 may further include an analog-to-digital converter ADC and a plurality of switches SAM, SPRE, and RPRE. Alternatively, the analog-to-digital converter ADC and the plurality of switches SAM, SPRE, and RPRE may be located outside of the data driver circuit 130.

In addition, although the compensator COMP may be present outside of the timing controller 140, the compensator COMP may be included within the timing controller 140. The memory MEM may be located outside of the timing controller 140, or may be provided in the form of a register within the timing controller 140.

Figure 5:
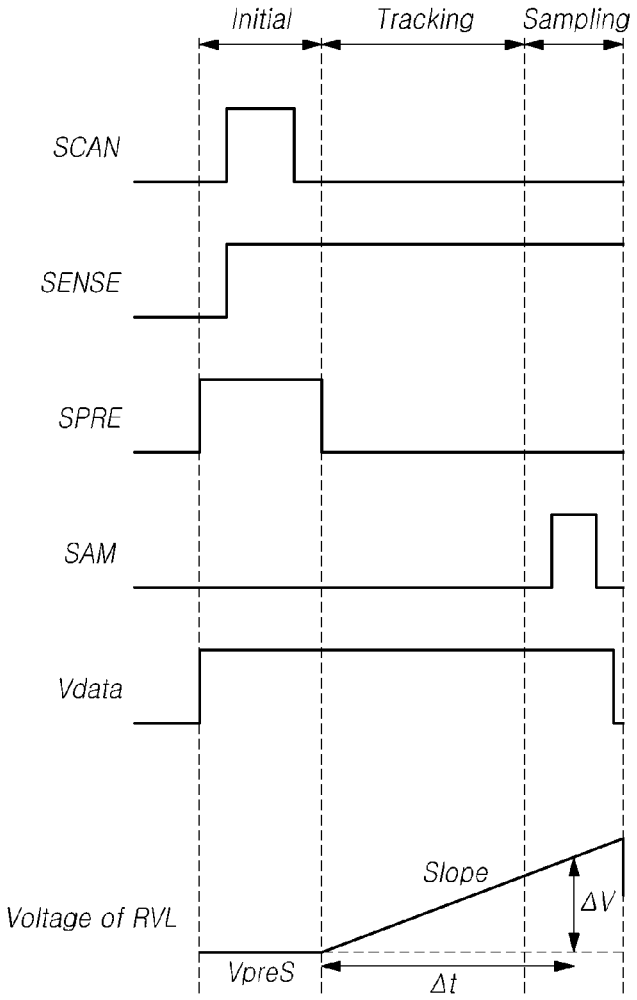
FIG. 5 illustrates a signal timing diagram of mobility sensing of characteristics of the driving transistor in the organic light-emitting display device according to one or more embodiments.

FIG. 5 illustrates a signal timing diagram of mobility sensing of characteristics of the driving transistor in the organic light-emitting display device according to one or more embodiments.

Referring to FIG. 5, in the organic light-emitting display device according to one or more embodiments, the mobility sensing driving on the driving transistor DRT may include an initialization step, a tracking step, and a sampling step. Since the mobility of the driving transistor DRT is generally sensed by individually turning the switching transistor SWT and the sensing transistor SENT on and off, the sensing operation may be performed by individually applying a scan signal SCAN and a sense signal SENSE (which may be referred to as "gate signal" together) to the switching transistor SWT and the sensing transistor SENT through two gate lines GL.

In the initialization step, the switching transistor SWT is turned on by the turn-on level scan signal SCAN, and the first node N1 of the driving transistor DRT is initialized to the mobility sensing data voltage Vdata. In addition, a turn-on level sense signal SENSE causes the sensing transistor SENT and sensing reference switch SPRE to be turned on. In this state, the second node N2 of the driving transistor DRT is initialized to the sensing reference voltage VpreS.

The tracking step is a step of tracking the mobility of the driving transistor DRT. The mobility of the driving transistor DRT may indicate current driving ability of the driving transistor DRT. In the tracking step, the voltage of the second node N2 of the driving transistor DRT, by which the mobility of the driving transistor DRT can be determined, is tracked.

In the tracking step, the turn-off level scan signal SCAN turns off the switching transistor SWT, and the sensing reference switch SPRE transits to a turn-off level (e.g., the sensing reference voltage VpreS is no longer applied to the reference voltage line RVL, and thus the blocking sensing reference voltage is no longer applied to the driving transistor DRT). Consequently, both the first node N1 and the second node N2 of the driving transistor DRT are floated, so that both the voltage of the first node N1 and the voltage of the second node N2 of the driving transistor DRT are increased. In particular, since the voltage of the second node N2 of the driving transistor DRT is initialized to the sensing reference voltage VpreS, the voltage of the second node N2 of the driving transistor DRT starts to increase from the sensing reference voltage VpreS. At this time, an increase in the voltage of the second node N2 of the driving transistor DRT causes a voltage increase in the reference voltage line RVL, since the sensing transistor SENT is in the turned-on state.

In the sampling step, the sampling switch SAM is turned on when a predetermined length of time Δt has passed from a point in time at which the voltage of the second node N2 of the driving transistor DRT started to increase. At this time, the analog-to-digital converter ADC may sense the voltage of the reference voltage line RVL connected by the sampling switch SAM, and may convert the sensed voltage into a digital sensed value. Here, the voltage sensed by the analog-to-digital converter ADC may correspond to a voltage VpreS+ΔV increased from the sensing reference voltage VpreS by a predetermined voltage ΔV.

The compensator COMP may determine the mobility of the driving transistor DRT in the corresponding subpixel SP, on the basis of the sensed value output from the analog-to-digital converter ADC, and may compensate for the deviation of the driving transistor DRT. The compensator COMP may determine the mobility of the driving transistor DRT, on the basis of the sensed value VpreS+ΔV measured by the sensing driving, the already-known sensing reference voltage VpreS, and the length of time Δt that has passed.

That is, the mobility of the driving transistor DRT is proportional to a voltage change per hour ΔV/Δt of the reference voltage line RVL in the tracking step. In other words, the mobility of the driving transistor DRT is proportional to a slope in a voltage waveform of the reference voltage line RVL. Here, the mobility deviation compensation for the driving transistor DRT may mean the image data changing process, i.e., a calculation process of multiplying the image data with the compensation value.

Although the structure of each of the subpixels SP has been described as having the 3T1C structure comprised of three transistors and one capacitor by way of example, this is merely for illustrative purposes, and one or more transistors, or in some cases, one or more capacitors may be further included. In addition, the plurality of subpixels SP may have the same structure, or some of the plurality of subpixels SP may have a different structure from the remaining subpixels.

In this case, the period, in which the characteristics of the driving transistor DRT are sensed, may start before the start of the image driving after a power-on signal is generated. Such sensing and such a sensing process may also be referred to as on-sensing and an on-sensing process. In addition, the period, in which the characteristics of the driving transistor DRT are sensed, may start after the generation of the power-off signal. Such sensing and such a sensing process may also be referred to as off-sensing and an off-sensing process.

In addition, the sensing period for the driving transistor may proceed in real time during the image driving. Such a sensing process may also be referred to as a real-time (RT) sensing process. In the case of the RT sensing process, the sensing process may be performed on one or more subpixels SP in one or more subpixels lines for every blank period during the image driving.

When the sensing process is performed in the blank period, a line of subpixels SP, on which the sensing process is performed, may be designated randomly. Consequently, after the sensing process has been performed in the blank period, images having an abnormal image quality, which would appear in the image driving period, may be reduced. In addition, after the sensing process has been performed during the blank period, a recovery data voltage may be supplied to the subpixel, on which the sensing process has been performed in the image driving period. Accordingly, after the sensing process in the blank period, images having an abnormal image quality, which would appear in the subpixel line on which the sensing process has been completed in the image driving period, may be further reduced.

In addition, in the case of the threshold voltage sensing process for the driving transistor DRT, the off-sensing process that would take a rather long time may be performed, since the saturation of the voltage of the second node N2 of the driving transistor DRT may take a large amount of time. In contrast, in the case of the mobility sensing process for the driving transistor DRT, at least one of the on-sensing process or the RT sensing process that would take for a relatively-short time may be performed, since the mobility sensing process may require a shorter time than the threshold voltage sensing process.

Here, black data insertion (BDI) driving may be used in order to improve the motion picture response time (MPRT) of the organic light-emitting display device 100. The BDI driving is intended to improve the MPRT by inserting black data into other subpixels SP than subpixels SP currently displaying the image data. The BDI driving is a driving technique of supplying a normal image data signal to the display panel 110 through the data line DL, so that the display panel 110 can display an image normally. Due to the BDI driving, black data BLACK is applied to another data line DL or a subpixel SP spaced apart from the data line DL, to which the normal image data signal is applied, by a certain distance.

Since the BDI driving is performed by inserting fake data between real image data, the BDI driving is also referred to as fake data insertion (FDI) driving. The BDI driving can display both the real image data and the black data BLACK in a single frame, thereby preventing the image from being blurred instead of being clearly distinguishable and improve the quality of display images.

The BDI driving is performed independently of the sensing driving on the driving transistor DRT. In general, the certain distance to the data line DL, to which the normal image data signal is applied, is maintained by setting the cycle, in which the black data BLACK is applied, to be the same.

Figure 6:
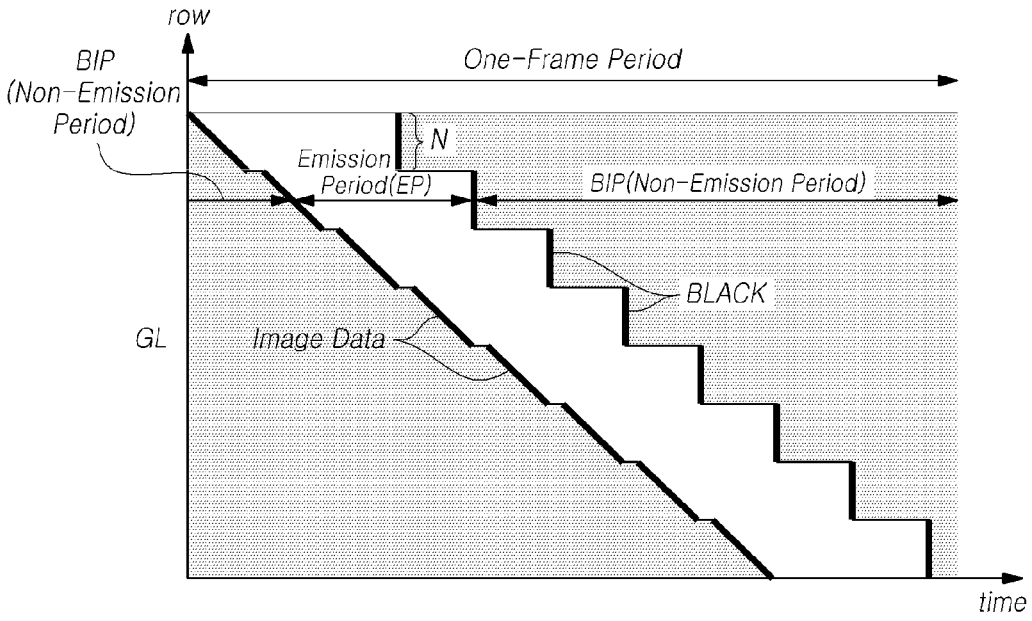
FIG. 6 illustrates a signal timing diagram of BDI driving in the organic light-emitting display device according to one or more embodiments.

FIG. 6 illustrates a signal timing diagram of BDI driving in the organic light-emitting display device according to one or more embodiments.

Referring to FIG. 6, in the display panel 110, a plurality of subpixels SP may be arrayed in rows and columns, in which a single gate line GL may be disposed in a corresponding row of subpixels SP, and a single data line DL may be disposed in a corresponding column of subpixels SP.

In a case in which the (n+1)th row of subpixels among the plurality of subpixels SP is driven, the scan signal SCAN and the sense signal SENSE are applied to the subpixels SP arrayed in the (n+1)th row, and the image-driving data voltage Vdata is supplied to the subpixels SP arrayed in the (n+1)th row through corresponding data lines DL. Afterwards, subpixels SP arrayed in the (n+2)th row positioned below the (n+1)th row are driven. That is, the scan signal SCAN and the sense signal SENSE are applied to the subpixels SP arrayed in the (n+2)th row, and the image-driving data voltage Vdata is supplied to the subpixels SP arrayed in the (n+2)th row.

In this manner, the image data is written sequentially in the plurality of rows of subpixels SP. Here, the image data writing step, the boosting step, and the emission step may be performed sequentially on the plurality of rows of subpixels SP during a one-frame period.

Here, an emission period EP in which the plurality of subpixels SP displays the image data does not continue throughout the one-frame period. Thus, black data BLACK may be displayed in a portion of the one-frame period other than the emission period EP. The portion of the one-frame period in which the black data BLACK is displayed in the one-frame period may be referred to as a non-emission period BIP in which the black data BLACK can be displayed, since the image data is not displayed therein.

With respect to the plurality of rows of subpixels SP, the one-frame period may include the emission period EP and the non-emission period BIP. Thus, the plurality of rows of subpixels SP perform the image driving in the emission period EP to display the image data and the BDI driving in the non-emission period BIP to display the black data BLACK. That is, the data voltage Vdata for displaying the image is supplied to the corresponding subpixels SP during the image driving. In contrast, during the BDI driving, the voltage of the black data BLACK is supplied to the subpixels SP. Here, the level or period of the image data voltage Vdata supplied to the subpixels SP may be changed depending on the frame or the composition of the image during the image driving. In contrast, in the case of the BDI driving, the voltage of the black data BLACK supplied to the subpixels SP may be constant regardless of the frame or the image.

In such BDI driving, after the insertion of the black data BLACK into a single row of subpixels SP, the black data BLACK may be inserted into a next row of subpixels SP. Otherwise, after the black data BLACK is inserted simultaneously to the plurality of rows of subpixels SP, the black data BLACK may be inserted into a plurality of next rows of subpixels SP. In addition, N number of rows of subpixels SP, into which the black data BLACK is inserted, may be set to be 2, 4 or 8 rows of subpixels SP, or the like, where the number "N" may be changed depending on the frame. Here, the N number of rows of subpixels SP, into which the black data BLACK is inserted, may have the same number as N-phases driving in which N number of gate lines GL are sequentially driven.

In the case of the BDI driving, the data voltage Vdata and the voltage of the black data BLACK may be applied at different times (or in different fractions of time) through a single data line DL. Alternatively, the voltage of the black data BLACK may be applied through the reference voltage line RVL, with image driving reference switch RPRE being in a turned-on state.

In addition, the length of the emission period EP may be adaptively adjusted depending on the image by adjusting the timing at which the black data BLACK is inserted. Points in time at which the image data voltage Vdata is inserted and points in time at which the voltage of the black data BLACK is inserted may be adjusted by controlling the gate driver circuit 120.

Figure 7:
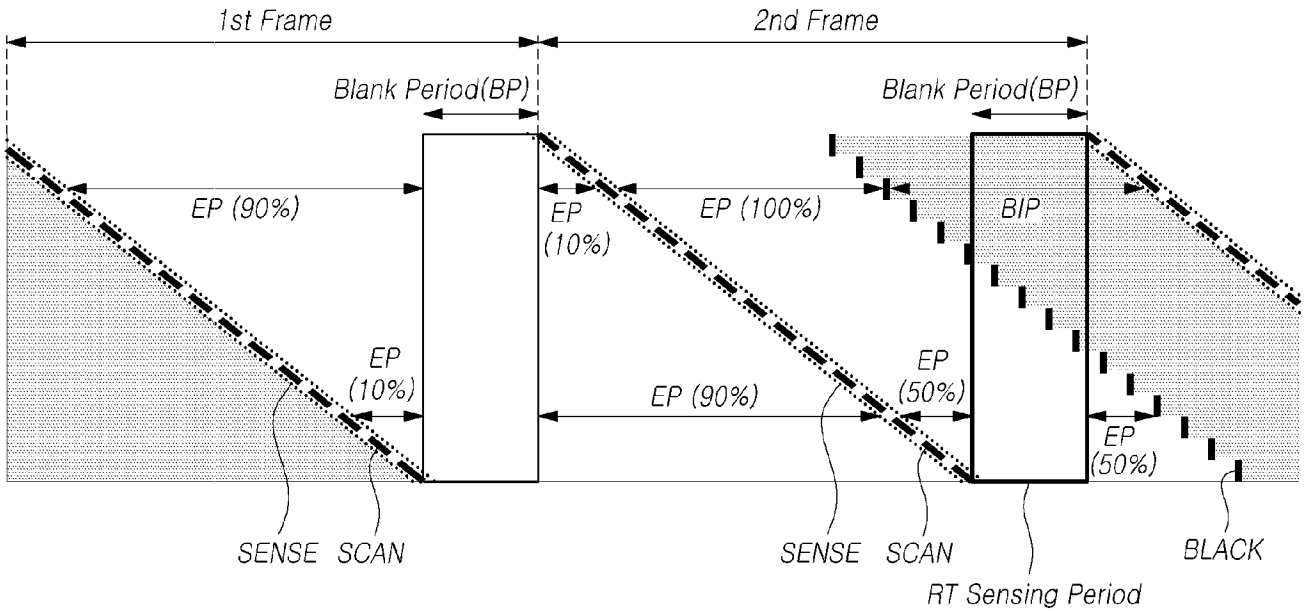
FIG. 7 illustrates a case in which black data is inserted into a plurality of subpixels in the organic light-emitting display device according to one or more embodiments.

FIG. 7 illustrates a case in which black data is inserted into a plurality of subpixels in the organic light-emitting display device according to one or more embodiments.

Referring to FIG. 7, BDI driving periods, i.e., periods in which the black data BLACK is inserted, may be set variously. A case in which the BDI driving is performed in a second frame period, instead of being performed in a first frame period, will be described hereinafter by way of example.

In the second frame period in which the BDI driving is performed, the emission period EP and the non-emission period BIP for each of the subpixels SP may be the same time interval or different time intervals. That is, if the BDI driving is not performed during the first frame period, the non-emission period BIP in which the black data BLACK is inserted is not present in the first frame period, and thus the entirety of the first frame period can be used as the time for the image driving. However, in the second frame period in which the BDI driving is performed, the image driving can be performed only in a portion of the emission period EP other than the non-emission period BIP in which the black data BLACK is inserted.

Accordingly, in a case in which the RT sensing driving is performed, the time interval between a point in time at which the scan signal SCAN is applied to a randomly-selected subpixel SP and a point in time at which the black data BLACK is inserted to the subpixel SP may vary depending on the position of the subpixel SP.

Figure 8:
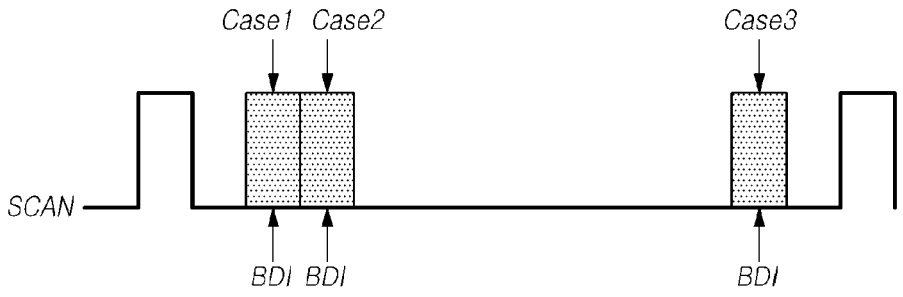
FIG. 8 illustrates three cases of relationships between a scan signal and black data in BDI driving in the organic light-emitting display device according to one or more embodiments.
Figure 9:
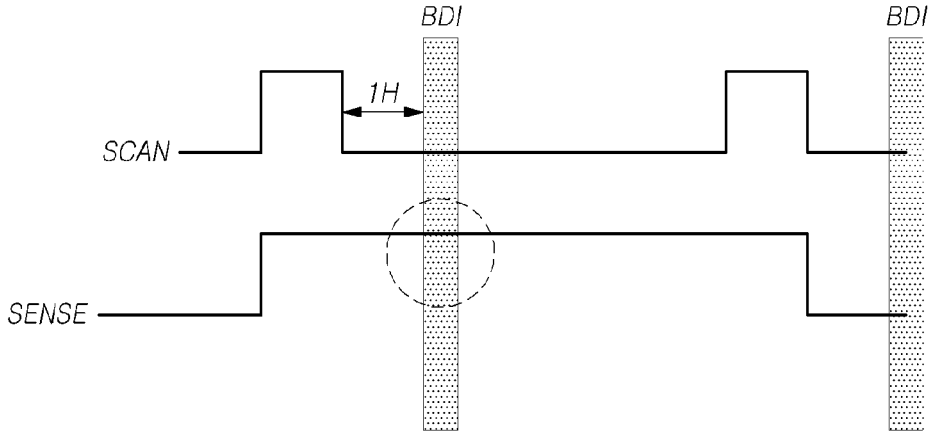
FIGS. 9, 10, and 11 respectively illustrate a case of a relationship between the scan signal and the black data.
Figure 10:
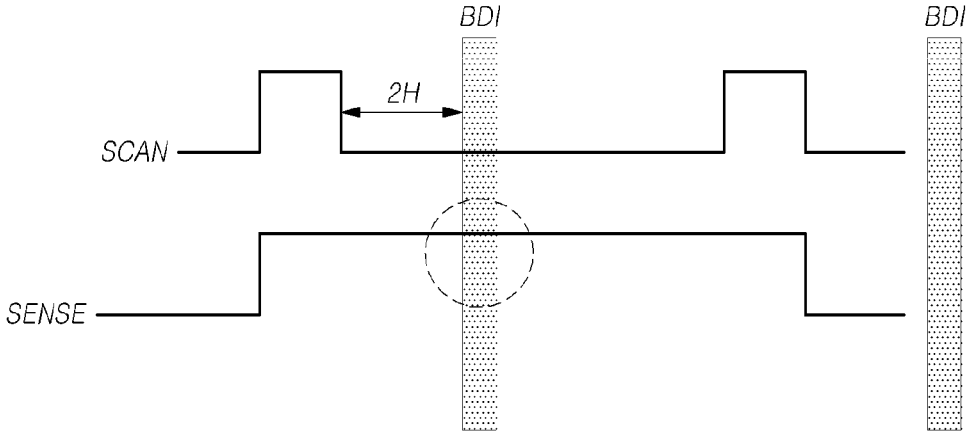
Figure 11:
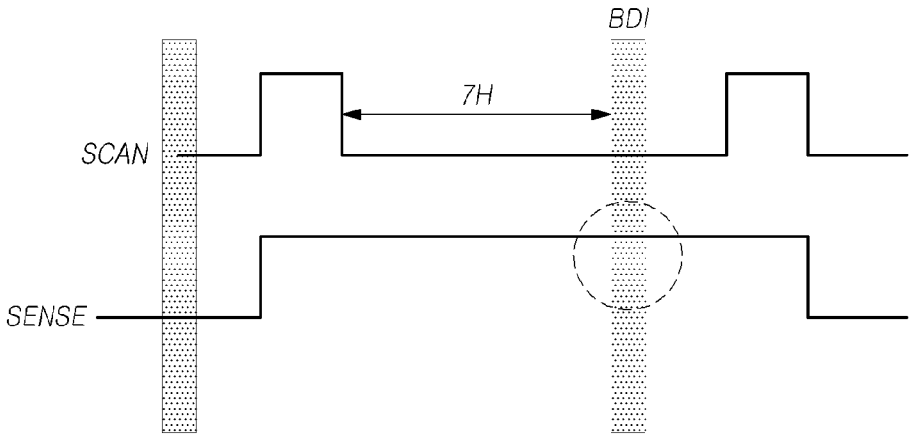

FIG. 8 illustrates three cases of relationships between a scan signal and black data in BDI driving in the organic light-emitting display device according to one or more embodiments, and FIGS. 9, 10, and 11 respectively illustrate a case of a relationship between the scan signal and the black data.

First, Referring to FIG. 8, black data insertion BDI may be performed in a variety of forms, between waveforms of the scan signal SCAN applied to subpixels SP at predetermined periodic intervals.

Eight-phase driving, in which the scan signal SCAN is output sequentially to first to eighth gate lines GL1 to GL8 and is then output sequentially to ninth to sixteenth gate lines GL9 to GL16, may be considered.

Since eight gate lines GL are sequentially driven from nth row to (n+7)th row of subpixels SP and then eight gate lines GL are sequentially driven from next eight rows of subpixels SP, the interval between waveforms of the high-level scan signal SCAN may have eight horizontal cycles 8H. Since one horizontal cycle 1H in which the black data BLACK is inserted and one horizontal cycle 1H in a precharging or recovery period may be included, the interval of the high-level scan signal SCAN may have ten horizontal cycles 10H.

Since the clock for the BDI driving is applied independently of the clock of the scan signal SCAN, the black data BLACK may be inserted into any horizontal cycle among the ten horizontal cycles 10H formed between high-level scan signals SCAN.

Herein, Case 1, in which black data insertion BDI is performed after one horizontal cycle, Case 2, in which black data insertion BDI is performed after two horizontal cycles, and Case 3, in which black data insertion BDI is performed after seven horizontal cycles 7H, from the application of the high-level scan signal SCAN, are illustrated.

Considering the three cases with reference to FIGS. 9 to 11, in the sensing of the characteristics of the driving transistor DRT, such as mobility, the scan signal SCAN supplied to the switching transistor SWT and the sense signal SENSE supplied to the sensing transistor SENT are applied separately. Thus, if the black data BLACK is inserted in a RT sensing period, the black data BLACK may overlap the sense signal SENSE. Accordingly, there may be a sensing deviation between a case in which the black data BLACK is inserted in a RT sensing period and a case in which the black data BLACK is not inserted in the RT sensing period.

The RT sensing of the characteristics of the driving transistor DRT may be performed by sequentially selecting each row of subpixels SP during the blank period BP in which neither image data nor black data is applied, randomly or according to the rule, or by selecting one or more subpixels SP in a specific row of subpixels SP. Here, the number of subpixels SP selectable from the specific row of subpixels SP may correspond to the number of analog-to-digital converters ADC. That is, a number of subpixels SP, equal to the number of the analog-to-digital converters ADC, may be sensed simultaneously.

In addition, RT sensing of the characteristics of the driving transistor DRT may be performed in every blank period BP.

Figure 12:
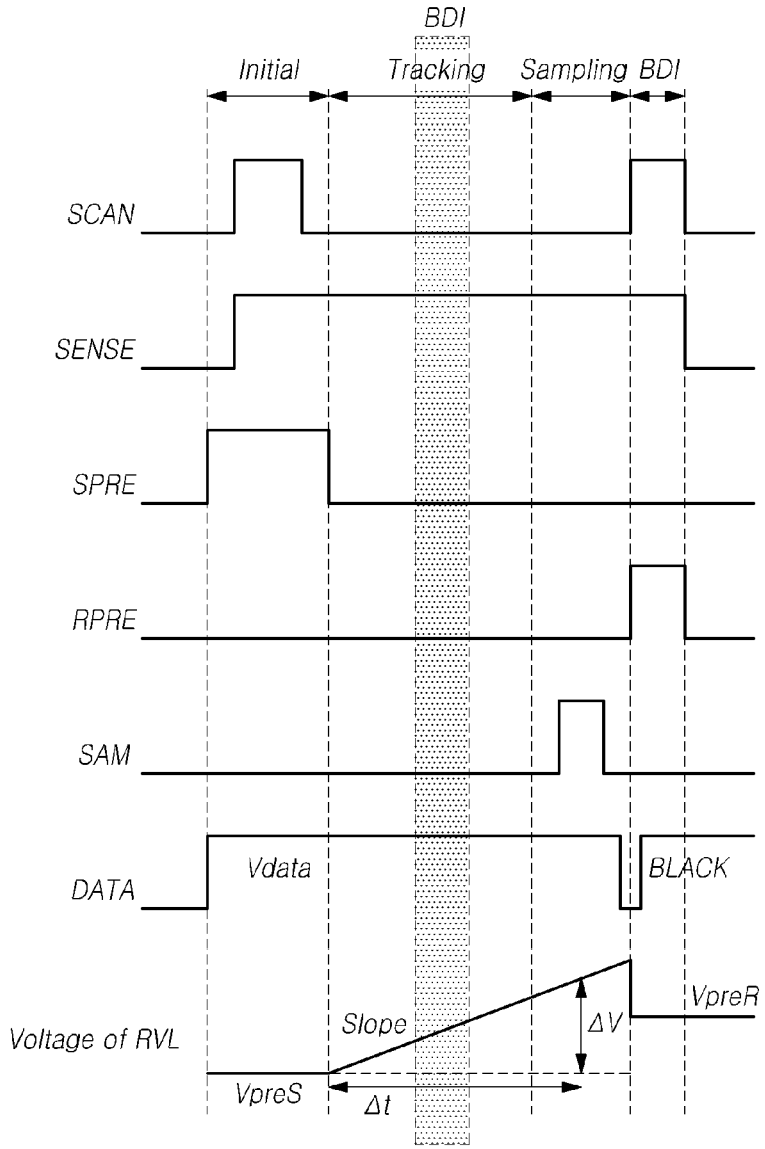
FIG. 12 illustrates a signal timing diagram of black data insertion during RT sensing driving in the organic light-emitting display device according to one or more embodiments.

FIG. 12 illustrates a signal timing diagram of black data insertion during RT sensing driving in the organic light-emitting display device according to one or more embodiments.

Referring to FIG. 12, the insertion of the black data BLACK intended to improve the MPRT of the organic light-emitting display device 100 may be performed at a point in time at which the RT sensing period is completed. That is, the BDI driving may be performed at a point in time at which an initialization step Initial, a tracking step Tracking, and a sampling step Sampling of sensing the characteristics of the driving transistor DRT, in particular, the mobility of the driving transistor DRT, are completed.

However, as described above, the BDI driving and the RT sensing driving are performed independently of each other, so that black data insertion BDI may be performed in the RT sensing period. Then, deviations may occur in the process of sensing the characteristics of the driving transistor DRT, and the driving transistor DRT may not be accurately compensated, so that the image quality of the display panel 110 may be degraded.

Figure 13:
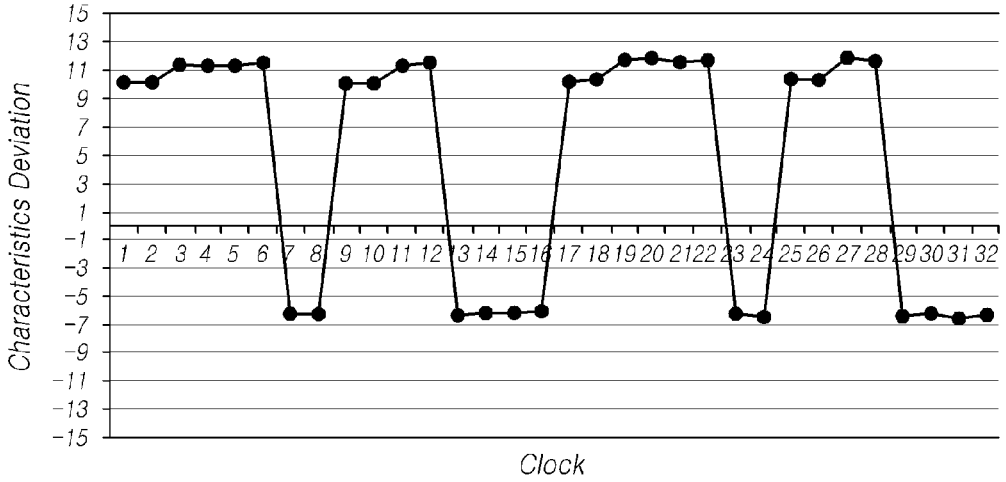
FIG. 13 illustrates deviations in characteristics of the driving transistor in a case in which the black data BLACK is inserted in an RT sensing period.

FIG. 13 illustrates deviations in characteristics of the driving transistor DRT in a case in which the black data BLACK is inserted in an RT sensing period.

According to one or more embodiments, driving is performed such that the scan signal SCAN and the sense signal SENSE are applied to the interval between applications of the black data BLACK in order to prevent the black data insertion BDI from occurring in the RT sensing period in which the characteristics of the driving transistor DRT are sensed.

Figure 14:
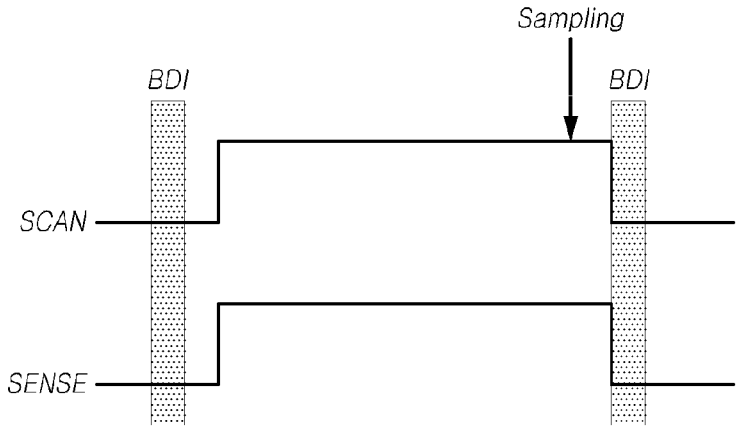
FIG. 14 illustrates a signal timing diagram of a scan signal and a sense signal, together with BDI periods in which black data is inserted, in the organic light-emitting display device according to one or more embodiments.

FIG. 14 illustrates a signal timing diagram of a scan signal SCAN and a sense signal SENSE, together with BDI periods in which black data is inserted, in the organic light-emitting display device according to one or more embodiments.

Referring to FIG. 14, in a RT sensing period in which the characteristics of the driving transistor DRT are sensed, the organic light-emitting display device 100 according to one or more embodiments applies the scan signal SCAN, by which the switching transistor SWT is on-off controlled, and the sense signal SENSE, by which the sensing transistor SENT is on-off controlled, between the BDI periods in which the black data is inserted. Since the shift timing of the scan signal SCAN or the sense signal SENSE may be controlled by a gate shift clock (GSC) commonly input to the gate driver ICs GDIC, the timing controller 140 may adjust the gate shift clock.

In a case in which 8 or higher phase driving as described above, the interval between the BDI periods may be nine horizontal cycles 9H, in consideration of the precharging or recovery period of one horizontal cycle 1H.

In this case, although the scan signal SCAN, by which the switching transistor SWT is on-off controlled, and the sense signal SENSE, by which sensing transistor SENT is on-off controlled, may be applied between the BDI periods while being supplied independently of each other, the scan signal SCAN and the sense signal SENSE may be applied between the BDI periods while being supplied simultaneously through a single gate line GL.

Consequently, the scan signal SCAN and the sense signal SENSE, having a high-level state, may be applied between the BDI periods in which the black data is inserted, and the RT sensing of the characteristics, in particular, the mobility, of the driving transistor DRT may be performed while the scan signal SCAN and the sense signal SENSE are in the high-level state, so that a sensing deviation among the subpixels SP can be reduced or minimized.

In a case in which the scan signal SCAN and the sense signal SENSE are applied between the BDI periods in which the black data is inserted as described above, points in time at which the black data BLACK is applied correlate with points in time at which the scan signal SCAN and the sense signal SENSE are applied. Thus, a clock signal, by which the black data BLACK is inserted, may be generated in concert (or synchronization) with the gate shift clock, by which the scan signal SCAN and sense signal SENSE are applied.

Figure 15:
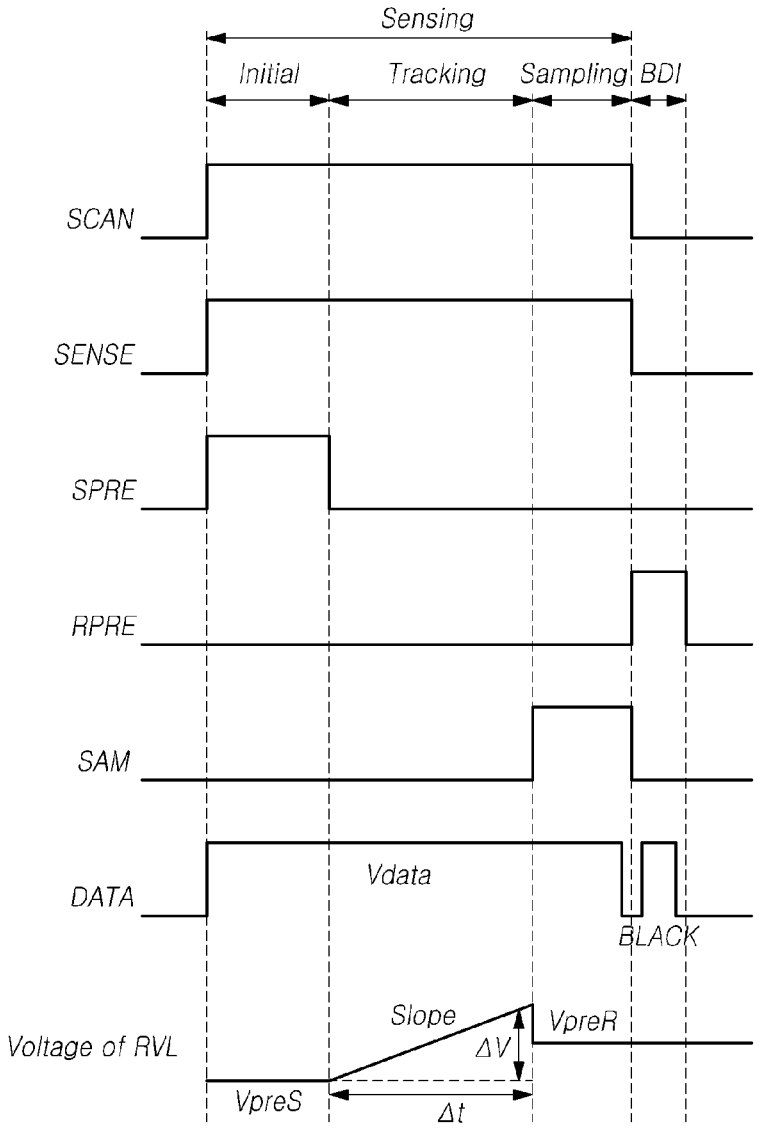
FIG. 15 illustrates a signal timing diagram of mobility sensing of the driving transistor in the organic light-emitting display device according to one or more embodiments.

FIG. 15 illustrates a signal timing diagram of mobility sensing of the driving transistor in the organic light-emitting display device according to one or more embodiments.

Referring to FIG. 15, in the organic light-emitting display device according to one or more embodiments, the mobility sensing of the driving transistor DRT may be performed in a RT sensing period, including the initialization step Initial, the tracking step Tracking, and the sampling step Sampling. Although it is possible to individually turn the switching transistor SWT and the sensing transistor SENT on or off by separating the scan signal SCAN and the sense signal SENSE through two gate lines GL as described above, the switching transistor SWT and the sensing transistor SENT may be simultaneously controlled by simultaneously applying the scan signal SCAN and the sense signal SENSE through a single gate line GL. In any case, the signal timing may be controlled so that the scan signal SCAN and the sense signal SENSE do not overlap in the BDI period in which the black data BLACK is inserted.

The initialization step Initial, the tracking step Tracking, and the sampling step Sampling may be performed in the same manner as in the existing RT sensing driving. Considering the precharging or recovery period of, for example, one horizontal cycle 1H in the eight-phase driving, the interval between the DBI periods may be nine horizontal cycles 9H, but the period in which the mobility of the driving transistor DRT can be sensed may be further narrowed.

In other words, the initialization step Initial may be a period in which the second node N2 of the driving transistor DRT is initialized to the sensing reference voltage VpreS. The period preceding the tracking step Tracking may take a certain length of time for an increase in the voltage of the second node N2 of the driving transistor DRT. In addition, the period in which the mobility of the driving transistor DRT can be substantially sensed may be reduced to three to five horizontal cycles 3H to 5H, in consideration of the precharging or recovery period.

Here, the range in which the voltage of the reference voltage line RVL reflecting the mobility of the driving transistor DRT can be sensed is determined by the resolution of the analog-to-digital converter. An increase in the voltage of the reference voltage line RVL can be sensed within the reduced RT sensing period. That is, in the period in which the mobility of the driving transistor DRT can be sensed, if there is an increase in the voltage of the reference voltage line RVL from the sensing reference voltage VpreS by a certain amount of voltage $\Delta V$, the increased amount of voltage $\Delta V$ can be sensed using the analog-to-digital converter ADC.

Accordingly, even in the case that the scan signal SCAN and the sense signal SENSE is applied between the BDI periods in which the black data BLACK is inserted, the characteristics of the driving transistor DRT can be accurately sensed.

The characteristics (e.g., mobility) of the driving transistor DRT sensed as described above may be compared with the reference value, so that the luminance uniformity among the subpixels SP can be obtained.

Figure 16:
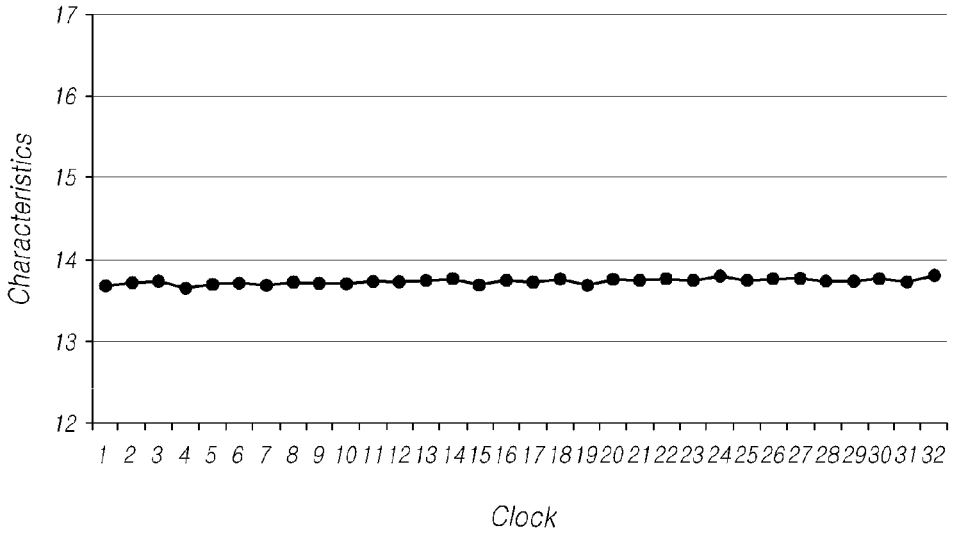
FIG. 16 illustrates results of characteristics sensing of the driving transistor in the organic light-emitting display device according to one or more embodiments in a case in which a scan signal and a sense signal are applied between BDI periods to prevent the BDI periods from overlapping an RT sensing period.

FIG. 16 illustrates results of characteristics sensing of the driving transistor DRT in the organic light-emitting display device according to one or more embodiments in a case in which a scan signal SCAN and a sense signal SENSE are applied between the BDI periods to prevent BDI periods from overlapping an RT sensing period.

Referring to FIG. 16, it can be appreciated that substantially no deviations occur in results of the sensing of the characteristics of the driving transistor DRT when the BDI period does not overlap the RT sensing period, differently from the case in which the BDI period overlaps the RT sensing period.

In addition, in the organic light-emitting display device 100 according to one or more embodiments, the RT sensing period in which the characteristics of the driving transistor DRT are sensed may further include a recovery step.

Figure 17:
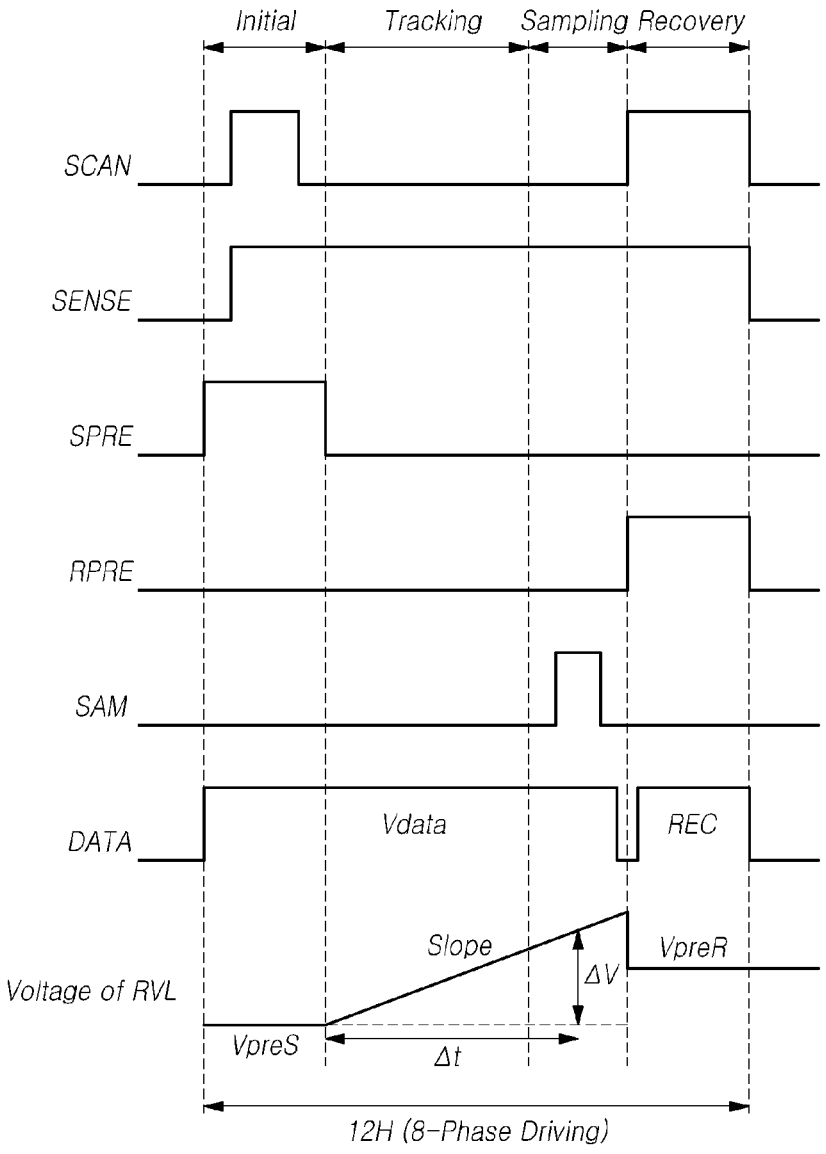
FIG. 17 illustrates a signal timing diagram of the sensing in the organic light-emitting display device according to one or more embodiments in a case in which the RT sensing period of the driving transistor further includes a recovery step.

FIG. 17 illustrates a signal timing diagram of the sensing in the organic light-emitting display device according to one or more embodiments in a case in which the RT sensing period of the driving transistor further includes a recovery step Recovery. Here, the recovery step may be illustrated separately from the RT sensing period or as being included in the RT sensing period.

Referring to FIG. 17, in the organic light-emitting display device according to one or more embodiments, the sensing of the characteristics, in particular, the mobility, of the driving transistor DRT may include the initialization step Initial, the tracking step Tracking, the sampling step Sampling, and the recovery step Recovery. Since the mobility of the driving transistor DRT is generally sensed by individually turning the switching transistor SWT and the sensing transistor SENT on or off, the sensing operation may be performed by individually applying the scan signal SCAN and the sense signal SENSE to the switching transistor SWT and the sensing transistor SENT.

Descriptions of the initialization step Initial, the tracking step Tracking, and the sampling step Sampling will be omitted, since they are identical to those described above.

When the voltage of the second node N2 of the driving transistor DRT is sensed in the sampling step Sampling, the recovery step may be performed. The recovery step may be a period ranging from after the completion of the RT sensing of the characteristics of the driving transistor DRT to before the start of the image driving. In the recovery step, after the RT sensing, a recovery voltage REC is applied in order to reset the voltage applied to each voltage line, so that the image driving can be performed. The recovery voltage REC may be applied through the reference voltage line RVL in a state in which the image driving reference switch RPRE is turned on.

For example, when eight-phase driving is performed, a period ranging from the initialization step Initial, in which the scan signal SCAN starts to be applied, to the completion of the recovery step, may be set to be twelve horizontal cycles 12H. In this case, when the initialization step Initial in which the second node N2 of the driving transistor DRT is initialized to the sensing reference voltage VpreS, the sampling step Sampling in which the voltage of the reference voltage line RVL is sampled, and the recovery step are excluded, the tracking step Tracking in which the voltage of the second node N2 of the driving transistor DRT is increased may be six horizontal cycles 6H.

As described above, when the BDI driving for improving the MPRT is not performed, the RT sensing and the recovery step Recovery may be performed to sense and recover the characteristics of the driving transistor DRT in the blank period BP. However, in a case in which the black data is inserted to improve the MPRT, it is beneficial to perform the RT sensing and the recovery step Recovery by avoiding the BDI period.

However, in a case in which the BDI period, in which the black data is inserted due to the BDI driving, is included, the period of the tracking step Tracking, in which the voltage of the second node N2 of the driving transistor DRT is increased, may be further reduced, thereby making it difficult to effectively perform the RT sensing.

Figure 18:
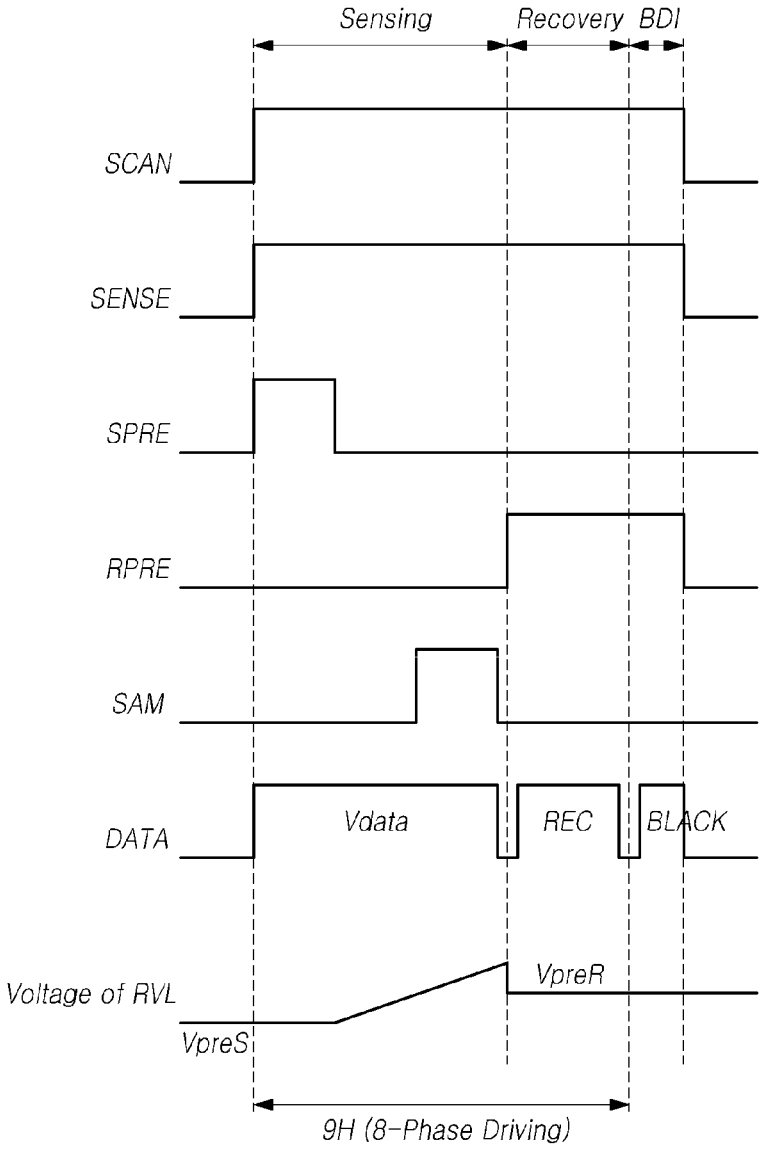
FIG. 18 illustrates a signal timing diagram of the RT sensing in the organic light-emitting display device according to one or more embodiments in a case in which the RT sensing including the recovery step is performed between BDI periods.

FIG. 18 illustrates a signal timing diagram of the RT sensing in the organic light-emitting display device according to one or more embodiments in a case in which the RT sensing including the recovery step Recovery is performed between BDI periods.

Referring to FIG. 18, in the organic light-emitting display device according to one or more embodiments, the RT sensing and the recovery step Recovery may be performed between the BDI periods in which the black data BLACK is inserted.

For example, in a case in which the eight-phase driving is performed, the interval between the BDI periods may be nine horizontal cycles 9H, since the recovery period Recovery of one horizontal cycle 1H is added. Thus, the RT sensing period in which the characteristics of the driving transistor DRT are sensed may be eight horizontal cycles 8H. Here, when the initialization step Initial in which the second node N2 of the driving transistor DRT is initialized to the sensing reference voltage VpreS, the sampling step Sampling in which the voltage of the reference voltage line RVL is sampled, and the recovery step are excluded, the tracking step Tracking in which the voltage of the second node N2 of the driving transistor DRT is increased may be significantly reduced to about two horizontal cycles 2H. In particular, reducing the BDI periods, in which the black data BLACK are inserted, or reducing the gate lines GL, through which the scan signal SCAN is applied sequentially, as in four-phase driving, may exacerbate this problem.

Consequently, a sufficient amount of time for the voltage of the second node N2 of the driving transistor DRT to be normally increased may not be obtained in the RT sensing period, so that an error may occur in the sensing of the characteristics of the driving transistor DRT.

This problem may be caused since the RT sensing of the characteristics of the driving transistor DRT and the recovery step Recovery are performed simultaneously in a single blank period BP. That is, in the blank period BP in a single frame, between the BDI period in which the black data is inserted and the image driving period in which the display panel is lit, the RT sensing of the characteristics of the driving transistor DRT is performed. Since both the RT sensing and the recovery step Recovery are performed simultaneously in the blank period BP, a sufficient amount of time for the voltage of the second node N2 of the driving transistor DRT to be normally increased may not be obtained.

Figure 19:
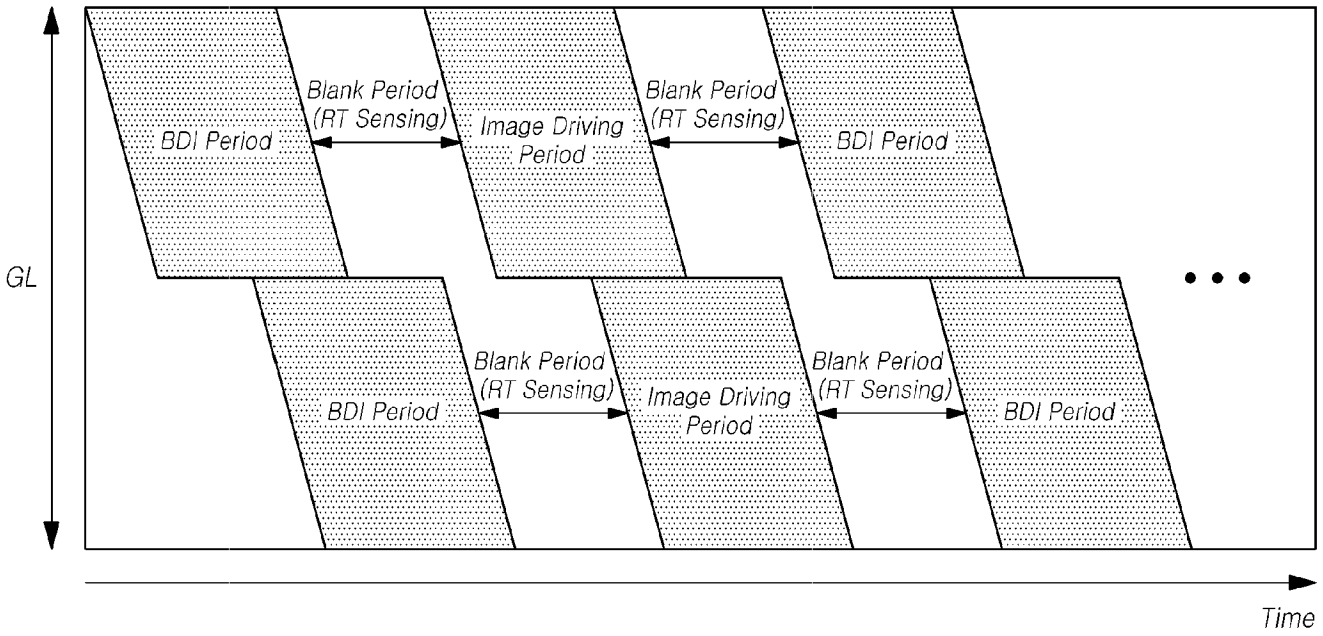
FIG. 19 illustrates a signal diagram in a case in which the RT sensing is performed in a blank period in the organic light-emitting display device.

FIG. 19 illustrates a signal diagram in a case in which the RT sensing is performed in a blank period in the organic light-emitting display device.

Referring to FIG. 19, a vertical direction indicates the gate lines GL, through which a scan signal is applied to the plurality of subpixels SP. In a case in which the organic light-emitting display device 100 has a resolution of 2,160×3,840, the vertical direction corresponds to 2,160 gate lines GL or 2,160 rows of subpixels SP. In addition, the vertical widths of the BDI period in which the black data is inserted, the blank period in which the RT sensing is performed, and the image driving period in which the subpixels SP are lit, may correspond to N number of subpixels SP to which the scan signal SCAN is applied sequentially, in response to N-phase driving.

Black data and image data having the same phase or different phases may be applied to the organic light-emitting display panel 110, in which the N-phase driving is being performed, depending on the time. Alternatively, the BDI period, in which the black data BLACK is applied, may be adjusted variably, depending on the frame. Here, illustrated is a case in which the RT sensing is performed to sense the characteristics of the driving transistor DRT in the blank period BP, after the BDI period in which the black data BLACK is inserted, and before the image driving period in which the subpixels SP are lit. At the completion of the image driving period, the BDI period in which the black data BLACK is inserted may start again. In general, in the blank period BP in which the RT sensing is performed, the recovery step Recovery is performed simultaneously with the RT sensing.

In this case, the characteristics of the driving transistor DRT are not significantly changed in a short amount of time, so that it may be less beneficial to simultaneously perform the RT sensing of the characteristics of the driving transistor DRT and the recovery step Recovery in every blank period BP. That is, the method of simultaneously performing the RT sensing of the characteristics of the driving transistor DRT and applying the recovery voltage to the sensed subpixels SP in every blank period BP may not be regarded as an effective compensation method of using the blank period BP.

In this regard, the organic light-emitting display device 100 according to one or more embodiments separately performs the RT sensing to sense the characteristics of the driving transistor DRT and the recovery step Recovery to recover the sensed subpixels SP. That is, the RT sensing of the characteristics of the driving transistor DRT is performed in a first blank period. In a second blank period subsequent to the first blank period, only the recovery step Recovery is performed on the subpixels SP sensed in the first blank period while the RT sensing is omitted. Accordingly, a sufficient amount of time for the RT sensing can be obtained in the blank period, and compensation for the deterioration of the driving transistor DRT can be effectively provided.

Figure 20:
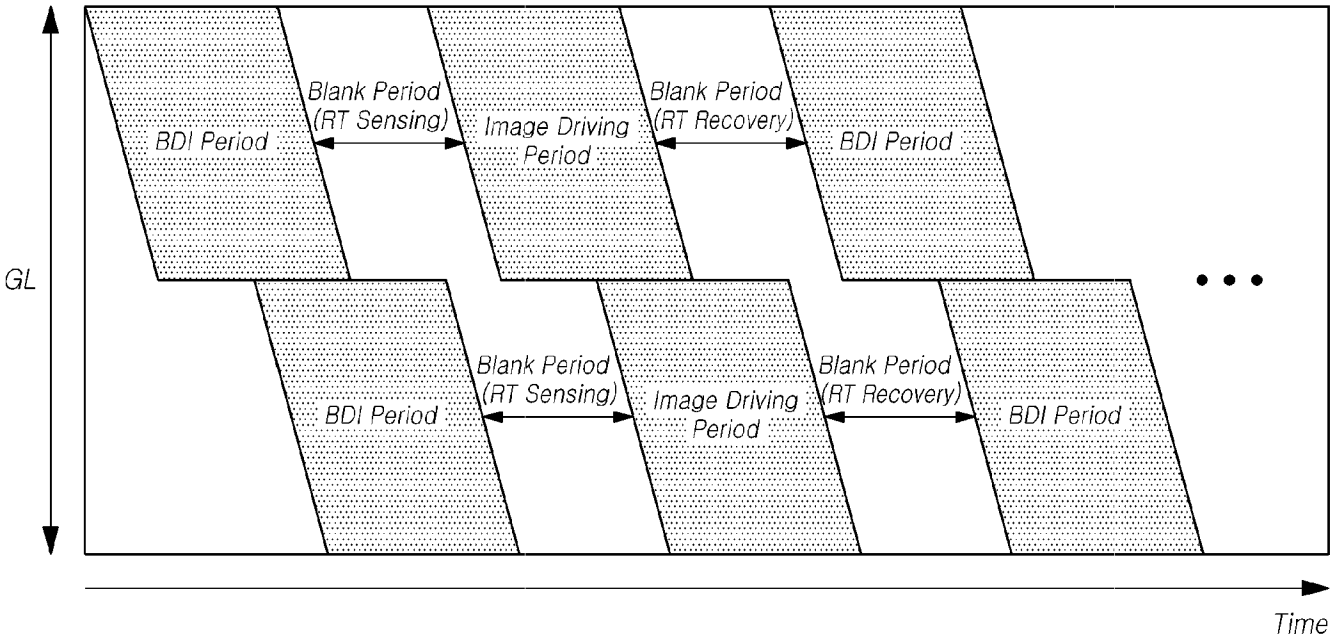
FIG. 20 illustrates a signal diagram in a case in which the RT sensing and the RT recovery are performed separately in a blank period in the organic light-emitting display device according to one or more embodiments.

FIG. 20 illustrates a signal diagram in a case in which the RT sensing and the RT recovery are performed separately in a blank period in the organic light-emitting display device according to one or more embodiments.

Referring to FIG. 20, in a first blank period subsequent to the BDI period in which the black data BLACK is inserted or the image driving period in which the subpixels SP are lit, the organic light-emitting display device 100 according to one or more embodiments performs the RT sensing of the characteristics of the driving transistor DRT. The characteristics of the driving transistor DRT sensed in this process may be stored in the memory within the timing controller 140 via the analog-to-digital converters ADC. In the first blank period, the recovery step Recovery of recovering the subpixels SP is not performed.

When the first blank period is completed, the image driving period or the BDI period may be performed. When the image driving period or the BDI period is completed, a second blank period may start. In this period, the RT sensing of the characteristics of the driving transistor DRT is not performed, and only the recovery step Recovery is performed to recover the subpixels SP sensed in the first blank period. Accordingly, the second blank period may be referred to as a RT recovery period.

In the second blank period in which the RT recovery is performed, a recovery data voltage may be supplied to the subpixels SP, on which the characteristics sensing has been performed in the first blank period. Thus, in the RT recovery period (i.e., the second blank period), none of the initialization step Initial, the tracking step Tracking, and the sampling step Sampling for sensing the characteristics of the driving transistor DRT are performed.

Accordingly, in the first blank period in which the characteristics of the driving transistor DRT are sensed, a sufficient amount of time for tracking the voltage of second node N2 of the driving transistor DRT can be obtained.

Although a case in which the characteristics of the driving transistor DRT of the subpixels SP of the organic light-emitting display device 100 are sensed has been described hereinabove by way of example, the process of separately performing the RT sensing and the RT recovery in the blank period can be used in cases in which the organic light-emitting diodes OLED are sensed.

Figure 21:
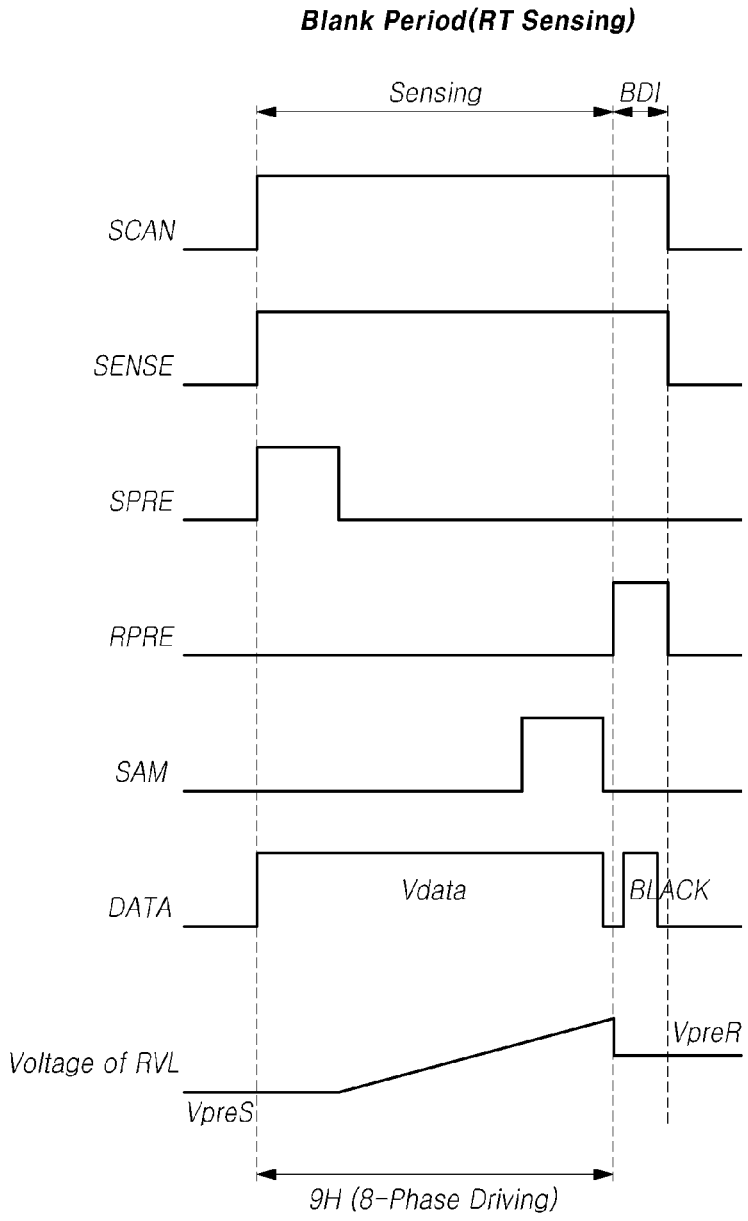
FIG. 21 illustrates a signal timing diagram of the organic light-emitting display device according to one or more embodiments in a case in which the RT sensing of characteristics of the driving transistor is performed in a first blank period.
Figure 22:
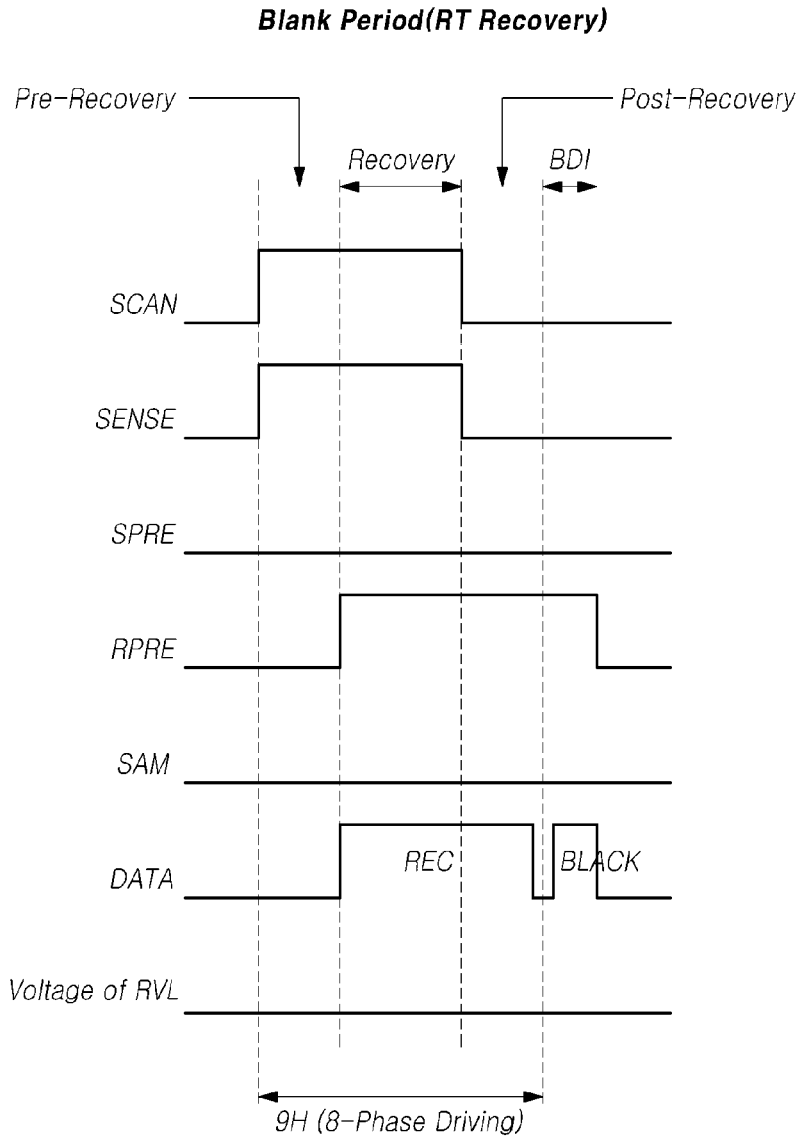
FIG. 22 illustrates a signal timing diagram in the organic light-emitting display device according to one or more embodiments in a case in which RT recovery is performed to recover a sensed subpixel in a second blank period.

FIG. 21 illustrates a signal timing diagram of the organic light-emitting display device according to one or more embodiments in a case in which the RT sensing of characteristics of the driving transistor is performed in a first blank period, and FIG. 22 illustrates a signal timing diagram in the organic light-emitting display device according to one or more embodiments in a case in which RT recovery is performed to recover a sensed subpixel in a second blank period.

First, referring to FIG. 21, the RT sensing process for sensing the characteristics of the driving transistor DRT is performed in the first blank period subsequent to the BDI period or the image driving period. The RT sensing process includes the initialization step Initial, the tracking step Tracking, and the sampling step Sampling for sensing the characteristics of the driving transistor DRT, such as mobility, and the recovery step Recovery is not performed.

For example, in a case in which the eight-phase driving is performed, a period between the initialization step Initial, in which the scan signal SCAN starts to be applied, and the BDI period, may be set to be nine horizontal cycles 9H. In addition to the eight cycles 8H in which the scan signal SCAN is applied to eight subpixels SP, one horizontal cycle 1H for blocking may be added.

In this case, the recovery step Recovery is not performed. Thus, when the initialization step Initial of initializing the second node N2 of the driving transistor DRT to the sensing reference voltage VpreS and the sampling step Sampling of sampling the voltage of the reference voltage line RVL are excluded, the tracking step Tracking in which the voltage of the second node N2 of the driving transistor DRT is increased can be obtained by about four horizontal cycles 4H. Accordingly, the voltage of the second node N2 of the driving transistor DRT can be sufficiently tracked, and characteristics can be accurately sensed.

In contrast, referring to FIG. 22, in a case in which the BDI period or the image driving period starts after the first blank period in which the characteristics of the driving transistor DRT are sensed, in the second blank period subsequent to the BDI period or the image driving period, only the recovery step Recovery is performed and the sensing of the characteristics of the driving transistor DRT is not performed. Accordingly, the second blank period may be referred to as a RT recovery period.

Since only the recovery step Recovery is performed in the second blank period (RT recovery period), none of the initialization step Initial, the tracking step Tracking, and the sampling step Sampling for sensing the characteristics of the driving transistor DRT is performed. Thus, in the case of eight-phase driving, a time interval of nine cycles 9H corresponding to an interval ranging from after the previous BDI period or the image driving period to before the subsequent BDI period may be used as a period in which a recovery voltage is applied to the subpixels SP.

In this case, since the state of charge in a case in which the recovery voltage is applied to the subpixels SP for the nine horizontal cycles 9H may be different from the state of charge in a case in which the image driving is performed, the characteristics of the driving transistor DRT may be lowered, contrary to the intention. In this regard, the recovery voltage may be applied to the subpixels SP, for example, only during two horizontal cycles 2H, and the recovery voltage may not be applied during either previous pre-recovery cycles or subsequent post-recovery cycles. The time interval in which the recovery voltage is actually applied, may be adjusted, depending on the structure and driving system or method of the organic light-emitting display device 100.

Here, since the gate driver circuit 120 sequentially outputting the scan signal SCAN to the plurality of gate lines GL disposed in the display panel 110 is controlled by the timing controller 140, a signal cycle in which the scan signal SCAN and the black data are applied, an application signal by which black data for the BDI period is applied, and a signal by which the RT sensing period and the RT recovery period are separately performed between the BDI periods or the image driving periods may be controlled by the timing controller 140 in accordance with driving signal application timing. In addition, a circuit able to adjust the cycle of the scan signal SCAN may be added, in the form of a module, to the gate driver circuit 120, or a circuit applying black data or a recovery voltage may be provided, in the form of a module, in the data driver circuit 130.

Although the organic light-emitting display device has been described by way of example, a person having ordinary skill in the art will appreciate that the technical features of the present disclosure can be applied to other display devices than the organic light-emitting display device.

The foregoing descriptions and the accompanying drawings have been presented in order to explain certain principles of the present disclosure by way of example. A person having ordinary skill in the art to which the present disclosure relates could make various modifications and variations without departing from the principle of the present disclosure. The foregoing embodiments disclosed herein shall be interpreted as being illustrative, while not being limitative, of the principle and scope of the present disclosure.

The various embodiments described above can be combined to provide further embodiments. Further changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A display device, comprising:

a display panel including a plurality of gate lines, a plurality of data lines, and a plurality of subpixels;

a gate driver circuit driving the plurality of gate lines;

a data driver circuit driving the plurality of data lines; and a timing controller controlling signals applied to the gate driver circuit and the data driver circuit, wherein each of the plurality of subpixels includes:

an organic light-emitting diode driven by a driving transistor;

a switching transistor electrically connected between a gate node of the driving transistor and a data line among the plurality of data lines;

a sensing transistor electrically connected between a source node or a drain node of the driving transistor and a reference voltage line; and a storage capacitor electrically connected between the gate node and the source node or the drain node of the driving transistor, wherein the timing controller controls the data driver circuit to apply a black data to a first subpixel of the plurality of subpixels, and controls the gate driver circuit to apply a scan signal of a turn-on level for controlling an operation of the switching transistor and a sense signal of a turn-on level for controlling an operation of the sensing transistor, which are signals for sensing a characteristic of a driving transistor of the first subpixel, in an interval between times at which the data driver circuit applies the black data to the first subpixel.

2. The display device according to claim 1, wherein the sensing of the characteristic of the driving transistor includes:

an initialization period in which, the switching transistor is turned on, and a sensing data voltage is supplied through the data line, and a sensing reference voltage is supplied through the reference voltage line;

a tracking period in which the sensing reference voltage to the driving transistor is blocked; and a sampling period in which the characteristic of the driving transistor is sensed through the reference voltage line.

3. The display device according to claim 1, wherein the scan signal and the sense signal are applied through a single gate line among the plurality of gate lines.

4. The display device according to claim 1, wherein a cycle of the black data applied is controlled to be the same as or different from a cycle of image data applied to the first subpixel.

5. The display device according to claim 1, further comprising a compensation circuit determining a compensation value for an image data voltage using a sensed value of the characteristic of the driving transistor and applying the image data voltage, changed according to the determined compensation value, to the first subpixel.

6. The display device according to claim 5, wherein the compensation circuit includes:

an analog-to-digital converter measuring a voltage of a reference voltage line electrically connected to the driving transistor and converting the measured voltage into a digital value;

a switch circuit electrically connected between the driving transistor and the analog-to-digital converter to control an operation of sensing the characteristic of the driving transistor;

a memory storing the sensed value output from the analog-to-digital converter or retaining a reference sensing value previously stored therein;

a compensator comparing the sensed value with the reference sensing value stored in the memory to determine the compensation value, by which a characteristic deviation of the driving transistor is compensated for;

a digital-to-analog converter converting the image data voltage, changed according to the compensation value determined by the compensator, into an analog image data voltage; and a buffer outputting the analog image data voltage, output from the digital-to-analog converter, to a data line designated from among the plurality of data lines.

7. The display device according to claim 6, wherein the black data is applied to the first subpixel via a switch circuit of the compensation circuit.

8. The display device according to claim 6, wherein the switch circuit includes a sensing reference switch and a sampling switch for controlling a sensing driving, wherein the sensing reference switch controls a connection between the reference voltage line and a sensing reference voltage supply node, to which a reference voltage is supplied, and the sampling switch controls a connection between the reference voltage line and the analog-to-digital converter.

9. The display device according to claim 8, wherein the switch circuit further comprises an image driving reference switch used in an image driving, wherein the image driving reference switch controls a connection between the reference voltage line and an image driving reference voltage supply node, to which the reference voltage is supplied.

10. The display device according to claim 6, wherein the voltage of the reference voltage line reflects a mobility of the driving transistor, and a range in which the voltage of the reference voltage line can be sensed is determined by a resolution of the analog-to-digital converter.

11. A method of driving a display device, the method comprising:

applying, by a data driver circuit, a black data to a first subpixel of a plurality of subpixels in a predetermined cycle; and applying a scan signal and a sense signal, by which a characteristic of a driving transistor of the first subpixel is sensed, in a period between points in time at which the black data is applied, and the scan signal and the sense signal of a turn-on level do not overlap the black data, wherein each of the plurality of subpixels includes:

an organic light-emitting diode driven by the driving transistor;

a switching transistor electrically connected between a gate node of the driving transistor and a data line among a plurality of data lines;

a sensing transistor electrically connected between a source node or a drain node of the driving transistor and a reference voltage line; and a storage capacitor electrically connected between the gate node and the source node or the drain node of the driving transistor, wherein the scan signal is for controlling an operation of the switching transistor included in the first subpixel, and the sense signal is for controlling an operation of the sensing transistor included in the first subpixel.

12. The method according to claim 11, further comprising:

supplying a sensing data voltage through a data line and a sensing reference voltage through a reference voltage line electrically connected to the first subpixel;

increasing a voltage of the reference voltage line by blocking the sensing reference voltage; and sensing the characteristic of the driving transistor through the reference voltage line.

13. The method according to claim 11, wherein a cycle of the black data applied is controlled to be the same as or different from a cycle of image data applied to the first subpixel.

14. The method according to claim 11, wherein the black data is applied to the first subpixel through a reference voltage line electrically connected to the driving transistor.

15. A display device, comprising:

a display panel including a plurality of gate lines, a plurality of data lines, and a plurality of subpixels;

a gate driver circuit driving the plurality of gate lines;

a data driver circuit driving the plurality of data lines; and a timing controller controlling signals applied to the gate driver circuit and the data driver circuit, wherein, neither image data nor black data is applied to the plurality of subpixels in a first blank period, the timing controller controls gate signals to sense a characteristic of a driving transistor in each of the plurality of subpixels in the first blank period and controls a recovery voltage to be applied in a second blank period subsequent to the first blank period to reset the plurality of subpixels on which characteristics sensing has been performed in the first blank period, and wherein, a first gate signal applied to a first subpixel of the plurality of subpixels in the first blank period does not overlap the black data applied to the first subpixel, wherein the first blank period includes:

an initialization period in which a sensing data voltage is supplied through a data line of the plurality of data lines and a sensing reference voltage is supplied through a reference voltage line electrically connected to the first subpixel;

a tracking period in which a voltage of the reference voltage line is increased by blocking the sensing reference voltage; and a sampling period in which the characteristic of a driving transistor in the first subpixel is sensed through the reference voltage line.

16. The display device according to claim 15, wherein the timing controller controls, by the data driver circuit, the black data to be applied to designated subpixels among the plurality of subpixels, and controls the gate signals for sensing the characteristic of the driving transistor to be applied in an interval between times at which the black data is applied.

17. A method of driving a display device, the method comprising:

neither image data nor black data is applied to a plurality of subpixels in a first blank period, applying gate signals to sense a characteristic of a driving transistor in each of the plurality of subpixels in a first blank period; and applying a recovery voltage in a second blank period to reset the plurality of subpixels on which characteristic sensing has been performed in the first blank period, wherein the second blank period is subsequent to the first blank period, wherein, a first signal of the gate signals for a first subpixel of the plurality of subpixels in the first blank period does not overlap the black data applied to the first subpixel, wherein the first blank period includes:

an initialization period in which a sensing data voltage is supplied through a data line and a sensing reference voltage is supplied through a reference voltage line electrically connected to the first subpixel;

a tracking period in which the sensing reference voltage to the first subpixel is blocked; and a sampling period in which the characteristic of a driving transistor in the first subpixel is sensed through the reference voltage line.

18. The method according to claim 17, further comprising:

applying, by a data driver circuit, the black data to the first subpixel of the plurality of subpixels; and applying the gate signals to sense the characteristic of the driving transistor in an interval between times at which the black data is applied.

19. A display device, comprising:

a display panel including a plurality of gate lines, a plurality of data lines, and a plurality of subpixels;

a gate driver circuit driving the plurality of gate lines;

a data driver circuit driving the plurality of data lines; and a timing controller controlling signals applied to the gate driver circuit and the data driver circuit, wherein the timing controller controls the data driver circuit to apply a black data to another data line spaced apart from a data line, to which an image data is applied, by a certain distance, and for a blank period in which neither the image data nor the black data is applied, the timing controller controls the gate driver circuit to apply a gate signal to sense a characteristic of a driving transistor in each of the plurality of subpixels, such that the gate signal does not overlap the black data, wherein the blank period includes a first blank period in which the timing controller controls the gate signal to sense the characteristic of the driving transistor and a second blank period subsequent to the first blank period in which the timing controller controls a recovery voltage to be applied to reset the plurality of subpixels on which characteristics sensing has been performed in the first blank period, wherein the first blank period includes:

an initialization period in which a sensing data voltage is supplied through a data line and a sensing reference voltage is supplied through a reference voltage line electrically connected to a first subpixel;

a tracking period in which the sensing reference voltage to the first subpixel is blocked; and a sampling period in which the characteristic of a driving transistor in the first subpixel is sensed through the reference voltage line.

20. A method of driving a display device including a display panel in which a plurality of data lines and a plurality of gate lines are disposed, a plurality of subpixels are aligned in intersected areas by the data lines and the gate lines to light organic light-emitting diodes via driving transistors, a data driver circuit driving the plurality of data lines, and a gate driver circuit driving the plurality of gate lines, the method comprising:

applying, by the data driver circuit, black data to apply a black data to another data line spaced apart from a data line, to which an image data is applied, by a certain distance; and for a blank period in which the image data is not applied, applying, by the gate driver circuit, a gate signal to sense a characteristic of a driving transistor in each of the plurality of subpixels, such that the gate signal does not overlap the black data, wherein the blank period includes a first blank period in which a timing controller controls the gate signal to sense the characteristic of the driving transistor and a second blank period subsequent to the first blank period in which the timing controller controls a recovery voltage to be applied to reset the plurality of subpixels on which characteristics sensing has been performed in the first blank period wherein the first blank period includes:

an initialization period in which a sensing data voltage is supplied through a data line and a sensing reference voltage is supplied through a reference voltage line electrically connected to a first subpixel;

a tracking period in which the sensing reference voltage to the first subpixel is blocked; and a sampling period in which the characteristic of a driving transistor in the first subpixel is sensed through the reference voltage line.

* * * * *